US007486488B2

(12) United States Patent
Wakatsuki et al.

(10) Patent No.: US 7,486,488 B2
(45) Date of Patent: Feb. 3, 2009

(54) ELECTRIC CONTACT SWITCHING DEVICE AND POWER CONSUMPTION CONTROL CIRCUIT

(76) Inventors: Noboru Wakatsuki, 9-12, Shinsakae 1-chome, Ishinomaki-shi, Miyagi (JP) 986-0004; Yu Yonezawa, 8-62, Aza Mineyama, Kogota-cho, Toda-Gun, Miyagi (JP) 987-0041

( * ) Notice: Subject to any disclaimer, the term of this patent is extended or adjusted under 35 U.S.C. 154(b) by 357 days.

(21) Appl. No.: 10/577,406

(22) PCT Filed: Sep. 16, 2004

(86) PCT No.: PCT/JP2004/013554

§ 371 (c)(1),
(2), (4) Date: Apr. 27, 2006

(87) PCT Pub. No.: WO2005/041231

PCT Pub. Date: May 6, 2005

(65) Prior Publication Data

US 2007/0064356 A1 Mar. 22, 2007

(30) Foreign Application Priority Data

| | | |
|---|---|---|
| Oct. 28, 2003 | (JP) | 2003-366940 |
| Nov. 18, 2003 | (JP) | 2003-387435 |
| Jan. 23, 2004 | (JP) | 2004-015714 |
| Feb. 13, 2004 | (JP) | 2004-035992 |
| Jun. 22, 2004 | (JP) | 2004-183289 |
| Jul. 20, 2004 | (JP) | 2004-211028 |

(51) Int. Cl.
*H01H 9/30* (2006.01)
*H01H 1/00* (2006.01)

(52) U.S. Cl. ..... 361/11

(58) Field of Classification Search ..... 361/11
See application file for complete search history.

(56) References Cited

U.S. PATENT DOCUMENTS 4,005,340 A * 1/1977 Hartel ..... 361/3

(Continued)

FOREIGN PATENT DOCUMENTS

JP 31-14928 9/1956

(Continued)

OTHER PUBLICATIONS

Takagi, Tasuku, "Phenomenon of electrical discharge of arc of electric contact," 1995, pp. 41-51, Corona Publishing Co., Ltd., Tokyo, Japan, no month.

(Continued)

*Primary Examiner*—Ronald W Leja
(74) *Attorney, Agent, or Firm*—Oliff & Berridge, PLC

(57) ABSTRACT

A load is connected with a power supply. An energizing electric contact and a transient current contact are connected electrically in parallel with each other and can do time-coordinated making and breaking operation. A capacitor is connected in series with the transient current contact. During breaking operation of the energizing contact and keeping making state of the transient current contact, a transient current from the power supply flows into the capacitor and delay voltage increase of the energizing contact using voltage drop at an internal resistance of the power supply and the load.

13 Claims, 30 Drawing Sheets

U.S. PATENT DOCUMENTS

| | | | | | |
|---|---|---|---|---|---|
| 4,300,181 | A | * | 11/1981 | Premerlani | 361/4 |
| 4,550,356 | A | * | 10/1985 | Takahashi | 361/9 |
| 5,854,729 | A | * | 12/1998 | Degeneff et al. | 361/4 |

FOREIGN PATENT DOCUMENTS

| | | |
|---|---|---|
| JP | 47-6666 | 2/1972 |
| JP | 49-143731 | 12/1974 |
| JP | 51-24508 | 6/1976 |
| JP | 52-111667 | 9/1977 |
| JP | 53-128704 | 11/1978 |
| JP | 55-120301 | 9/1980 |
| JP | 56-25424 | 3/1981 |
| JP | 57-36620 | 2/1982 |
| JP | 58-129740 | 9/1983 |
| JP | 63-187542 | 12/1988 |
| JP | 6-70143 | 9/1994 |
| JP | 7-506215 | 7/1995 |
| JP | 9-245586 | 9/1997 |
| JP | 2003-115231 | 4/2003 |
| JP | 2003-230296 | 8/2003 |

OTHER PUBLICATIONS

Takahashi, Atsuo, "Research on generation area of point of contact arc," *Nippon Institute of Technology Research Report*, 1976, Separate vol. 1, p. 65, no month.

"Relay Technical booklet," Fujitsu Component, 2002, p. 337, no month.

Hamilton, A. et al., "Spark Quenching at Relay Contacts Interrupting D.C. Circuits," P.IEE, 1949, pp. 64, vol. 96, United States, no month.

Holm, R., "Electric Contacts Theory and Applications," 1967, pp. 60-68, pp. 279-286, 4th ed., Springer-Verlag, New York, no month.

* cited by examiner

【Fig.1】
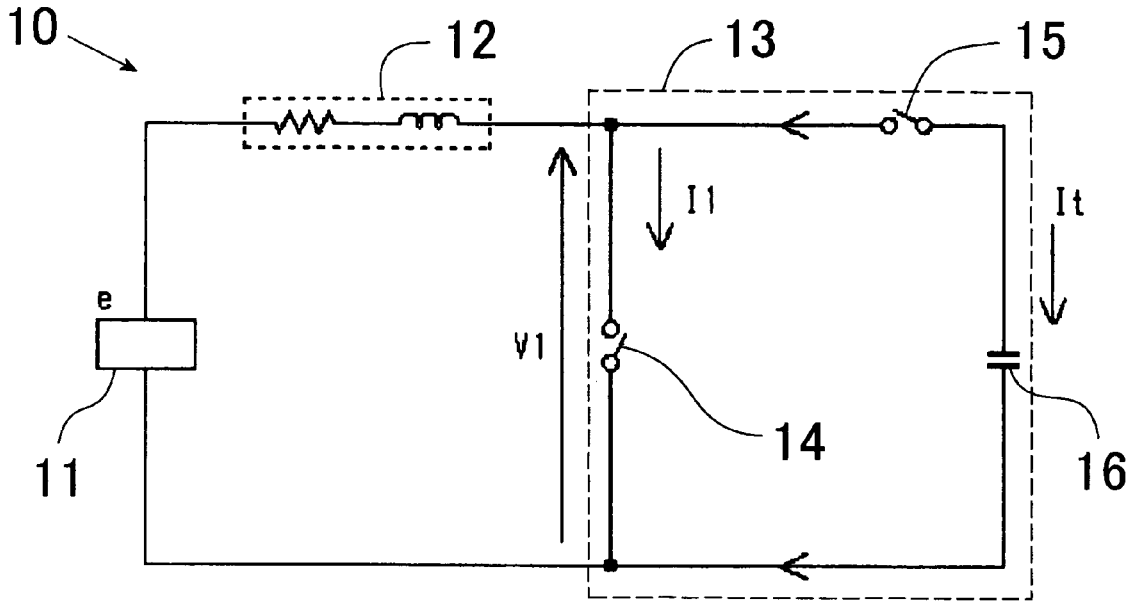

【Fig.2】
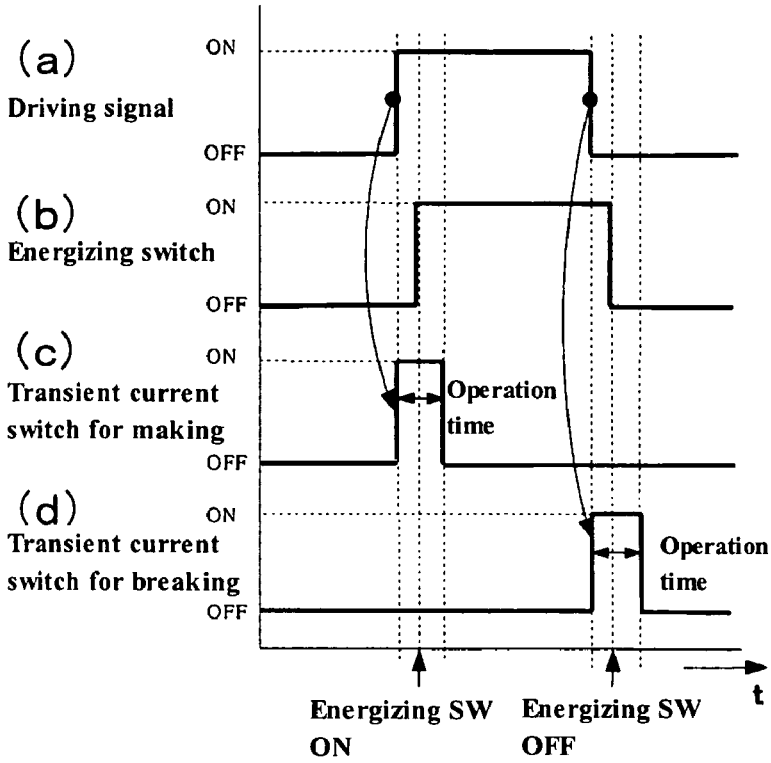
【Fig.3】
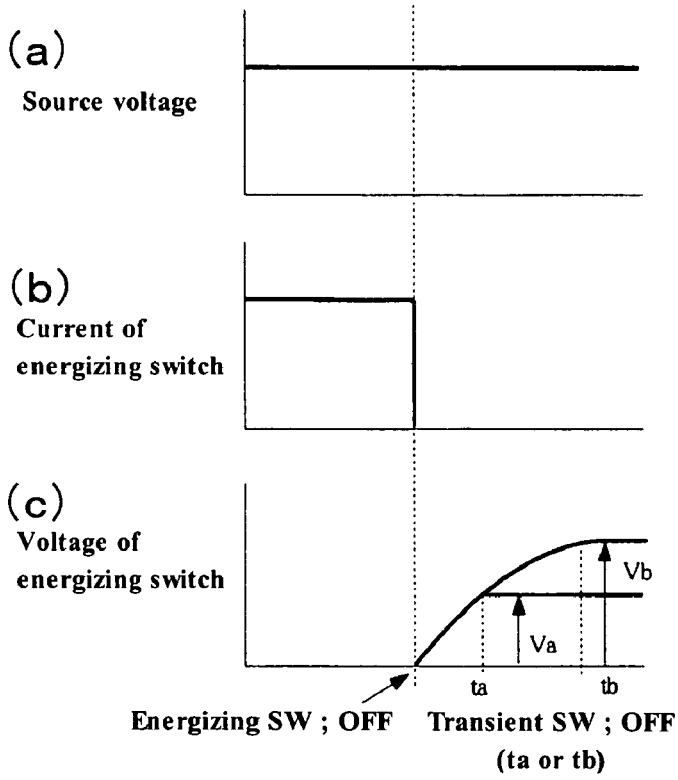

【Fig.4】
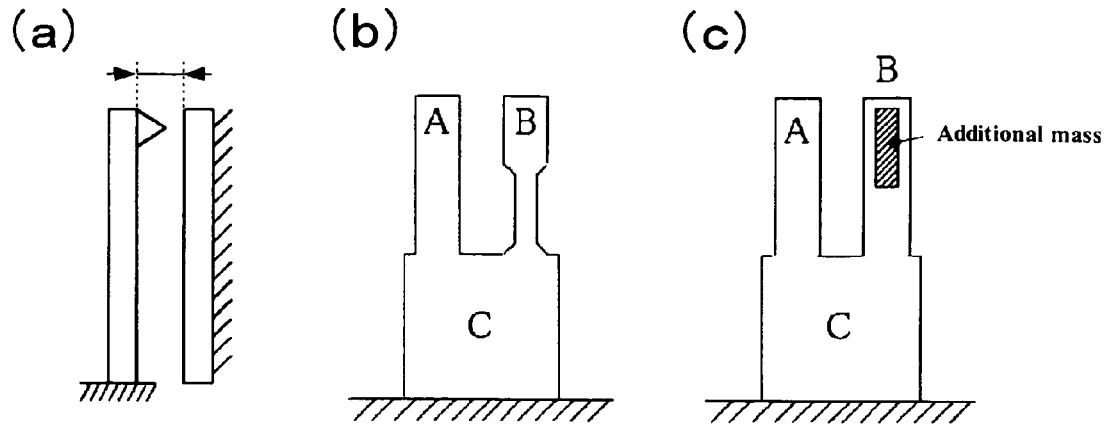
【Fig.5】
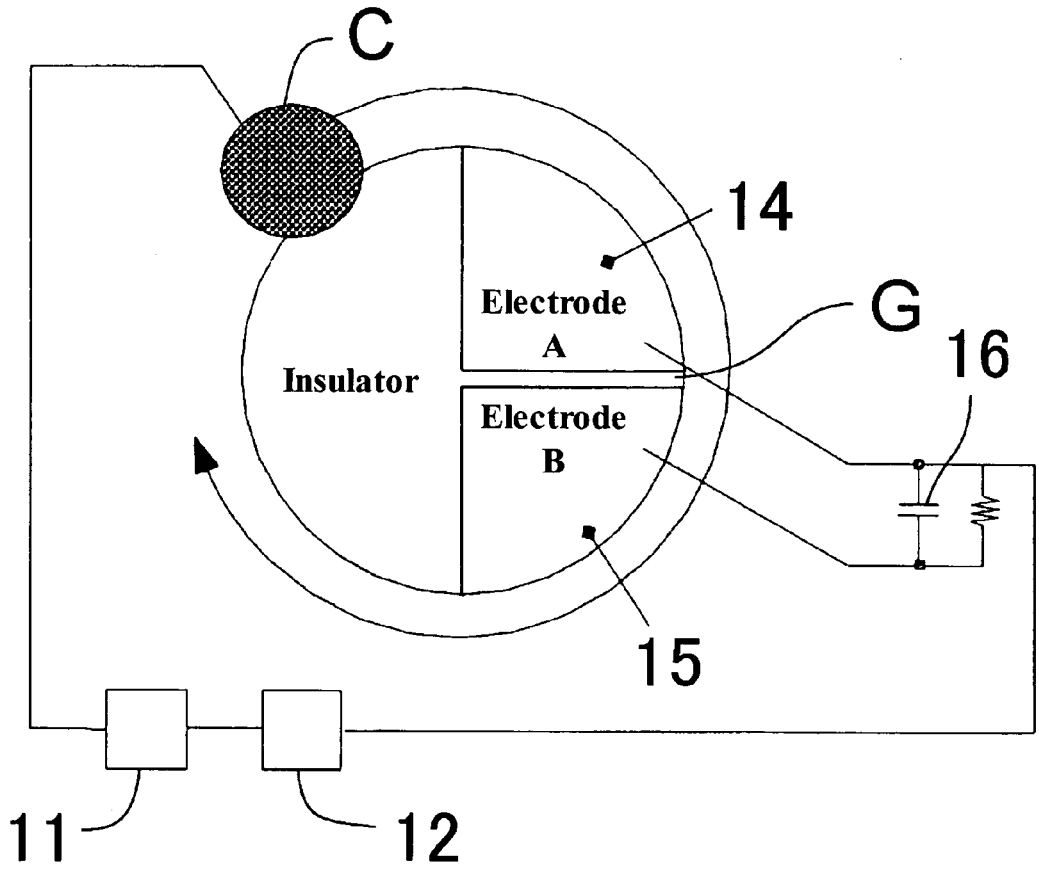

【Fig.6】
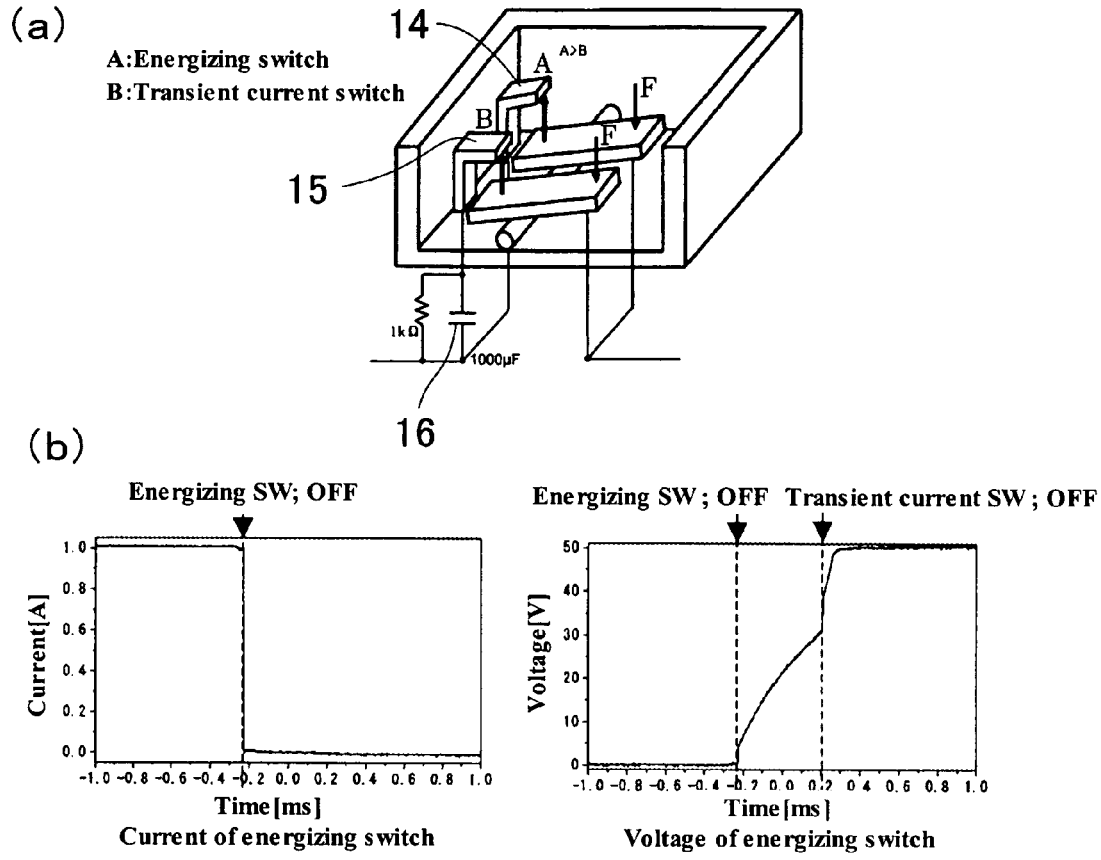

【Fig.7】
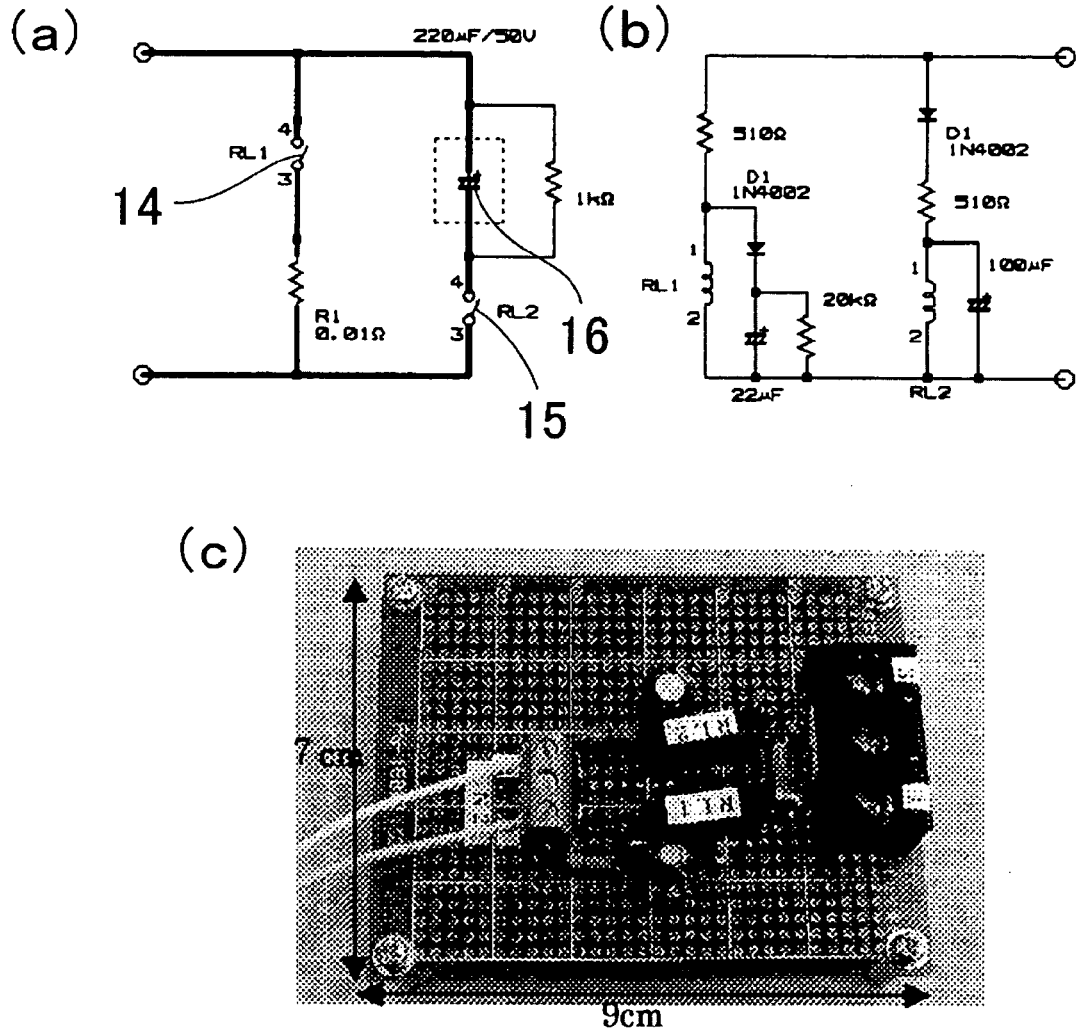
【Fig.8】
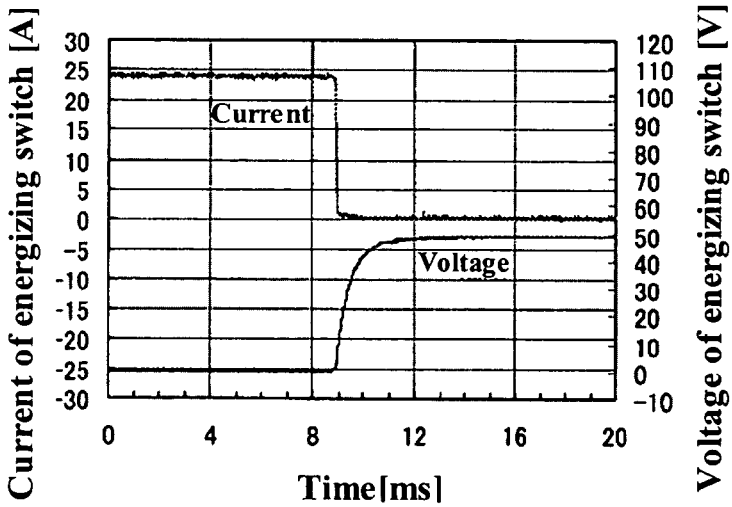

【Fig.9】
(a)
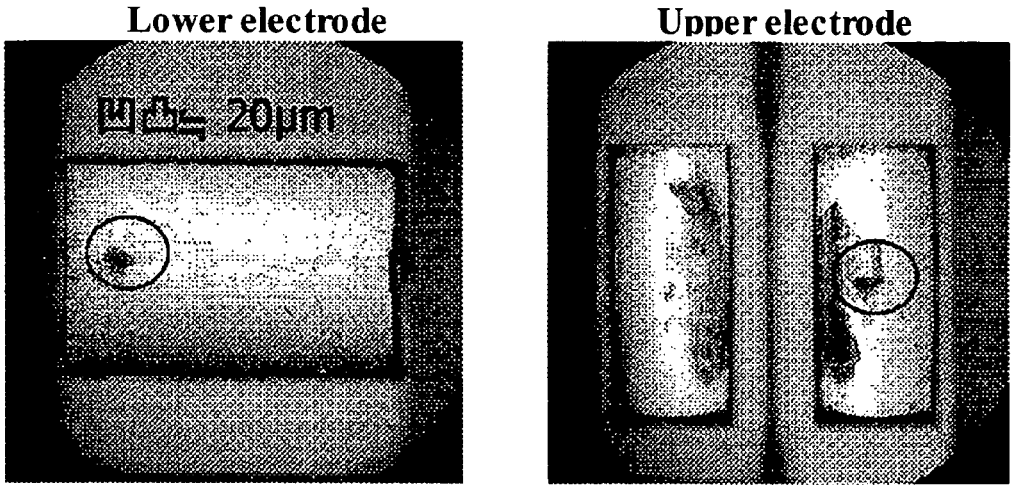
(b)
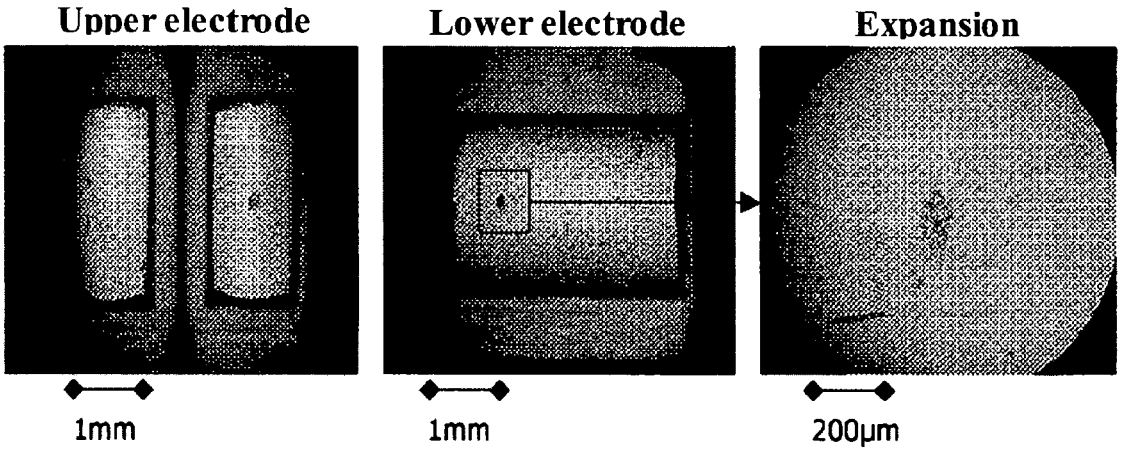

【Fig.10】
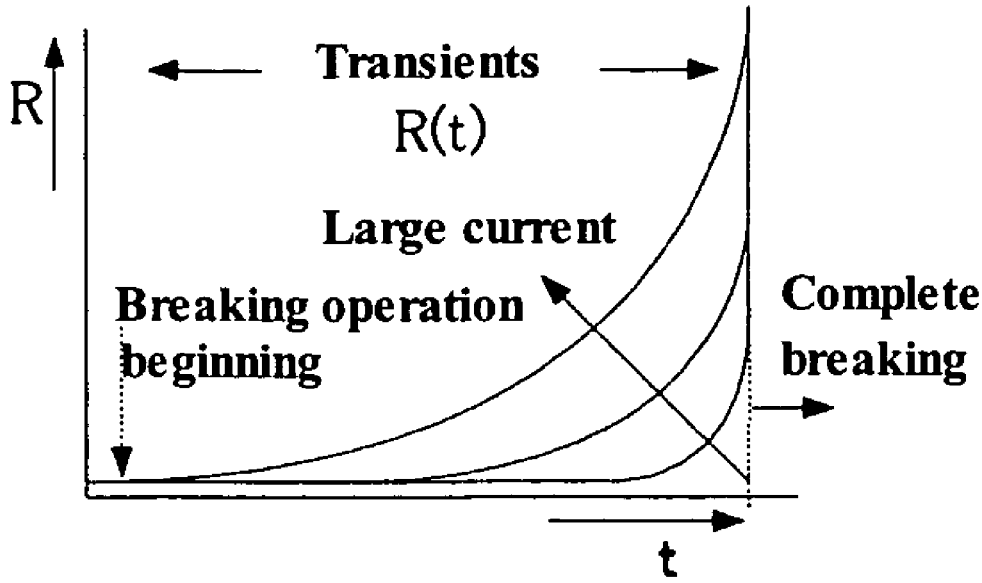

【Fig.11】
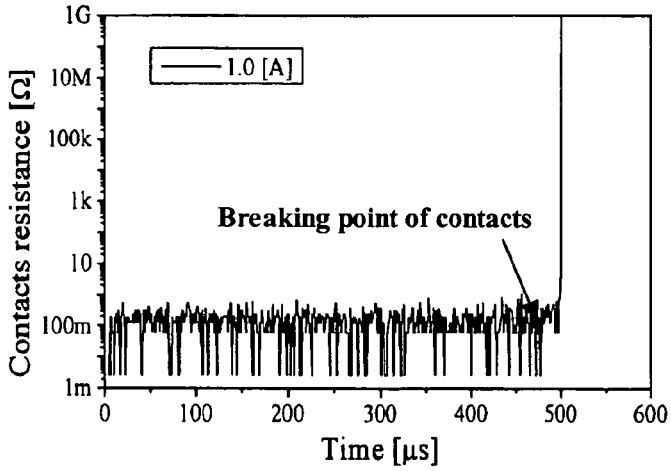
C:0.01μF, Current:1A
【Fig.12】
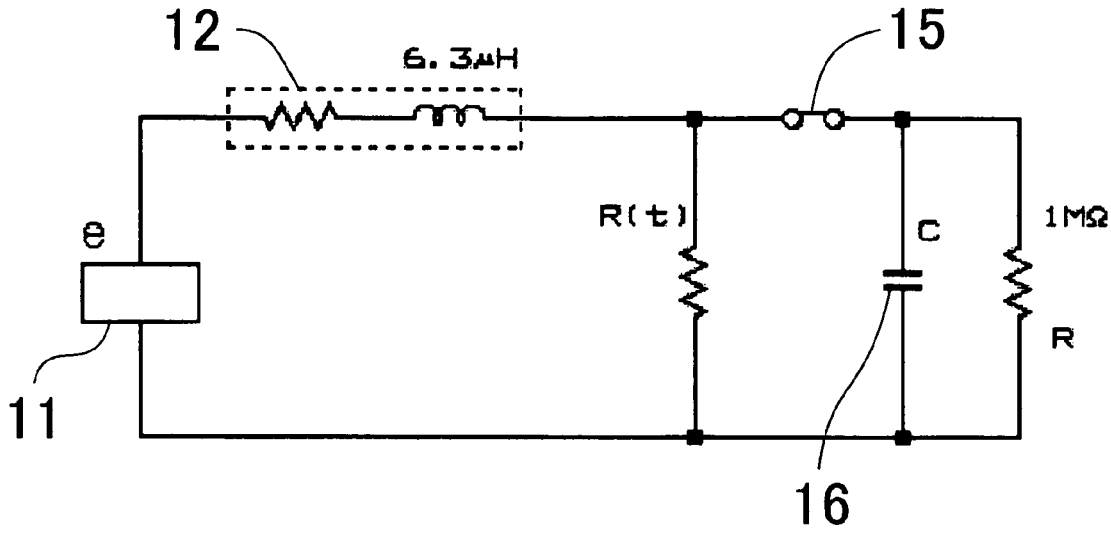

【Fig.13】
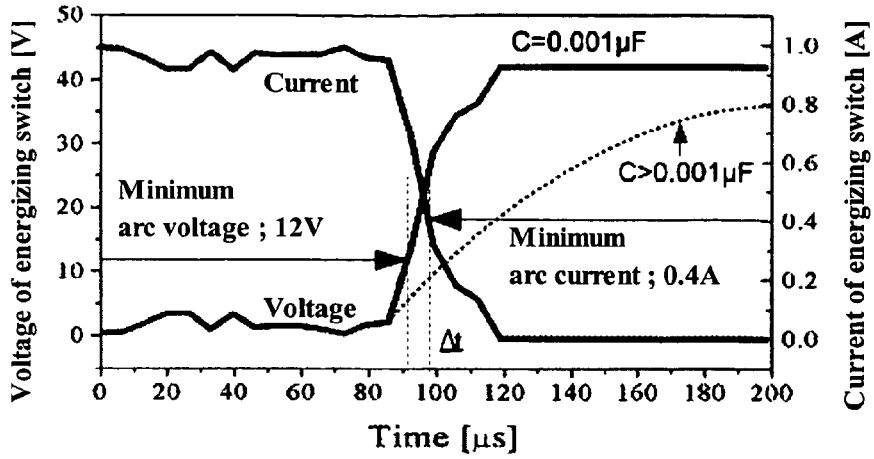
【Fig.14】
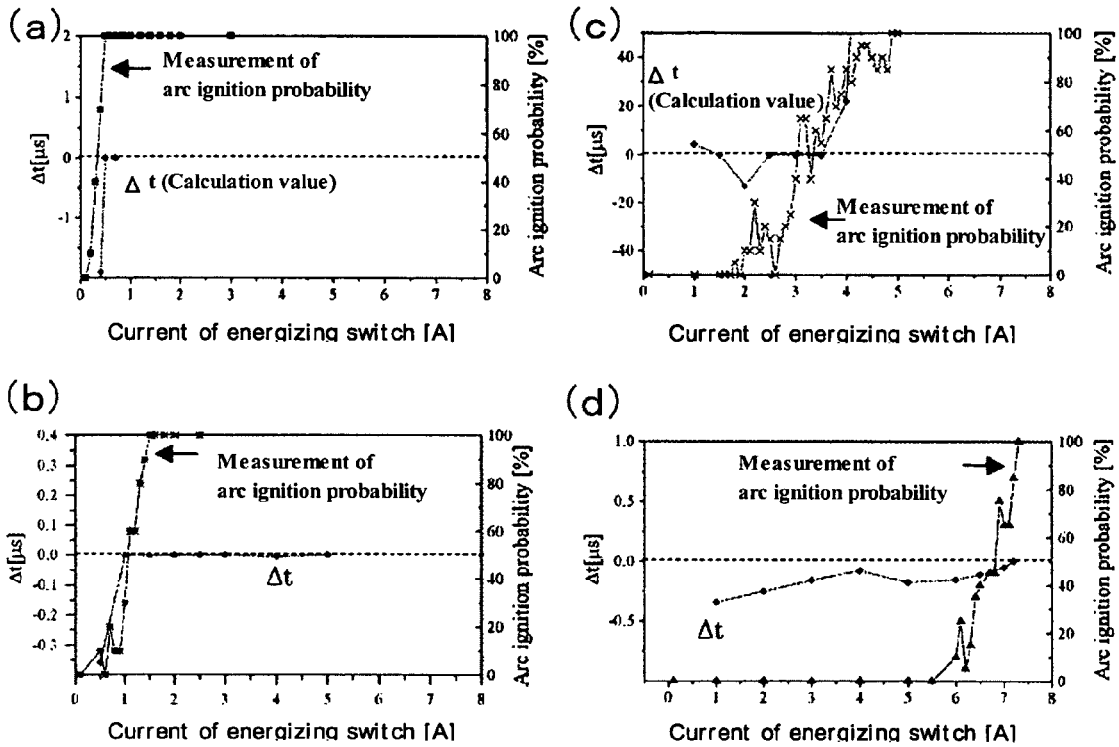

【Fig.15】
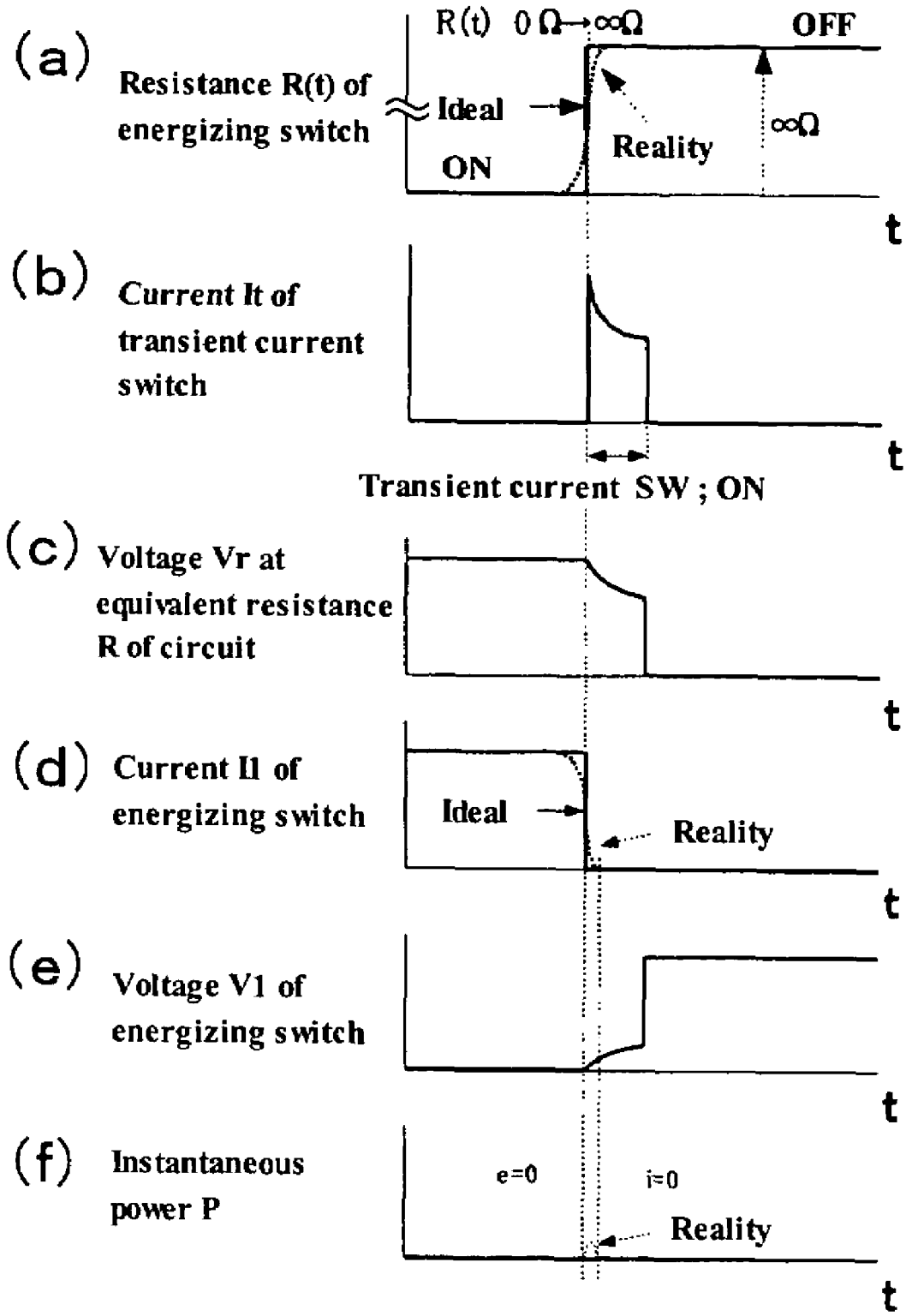

【Fig.16】
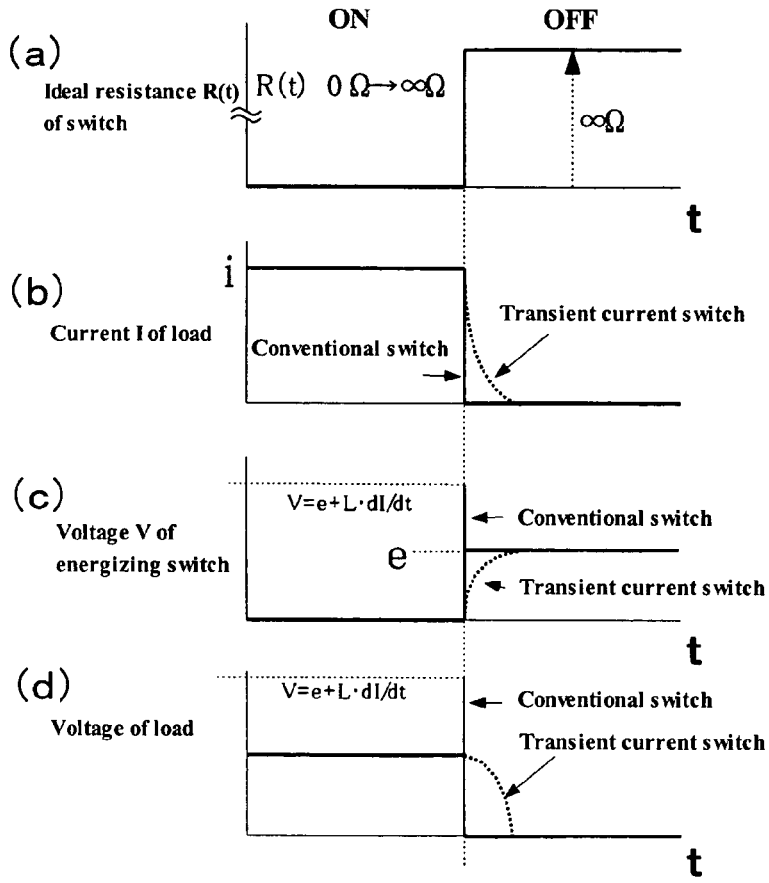
【Fig.17】
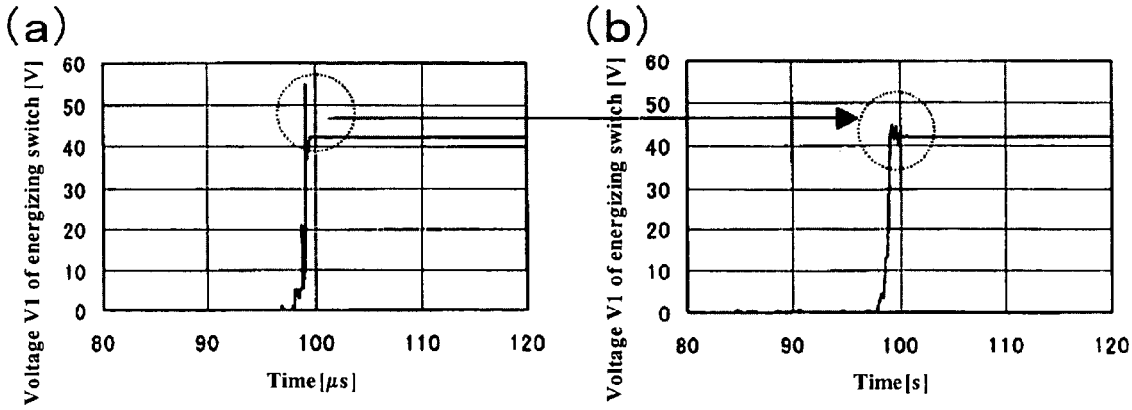

【Fig.18】
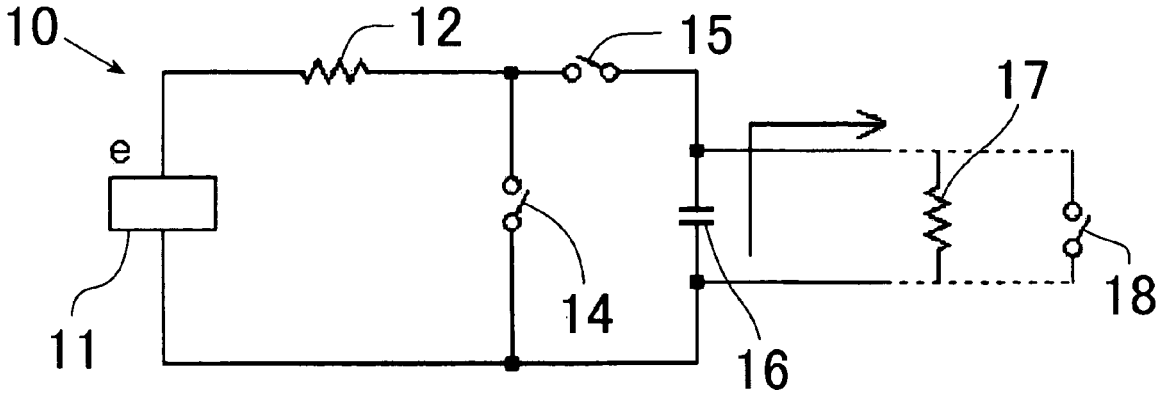

【Fig.19】
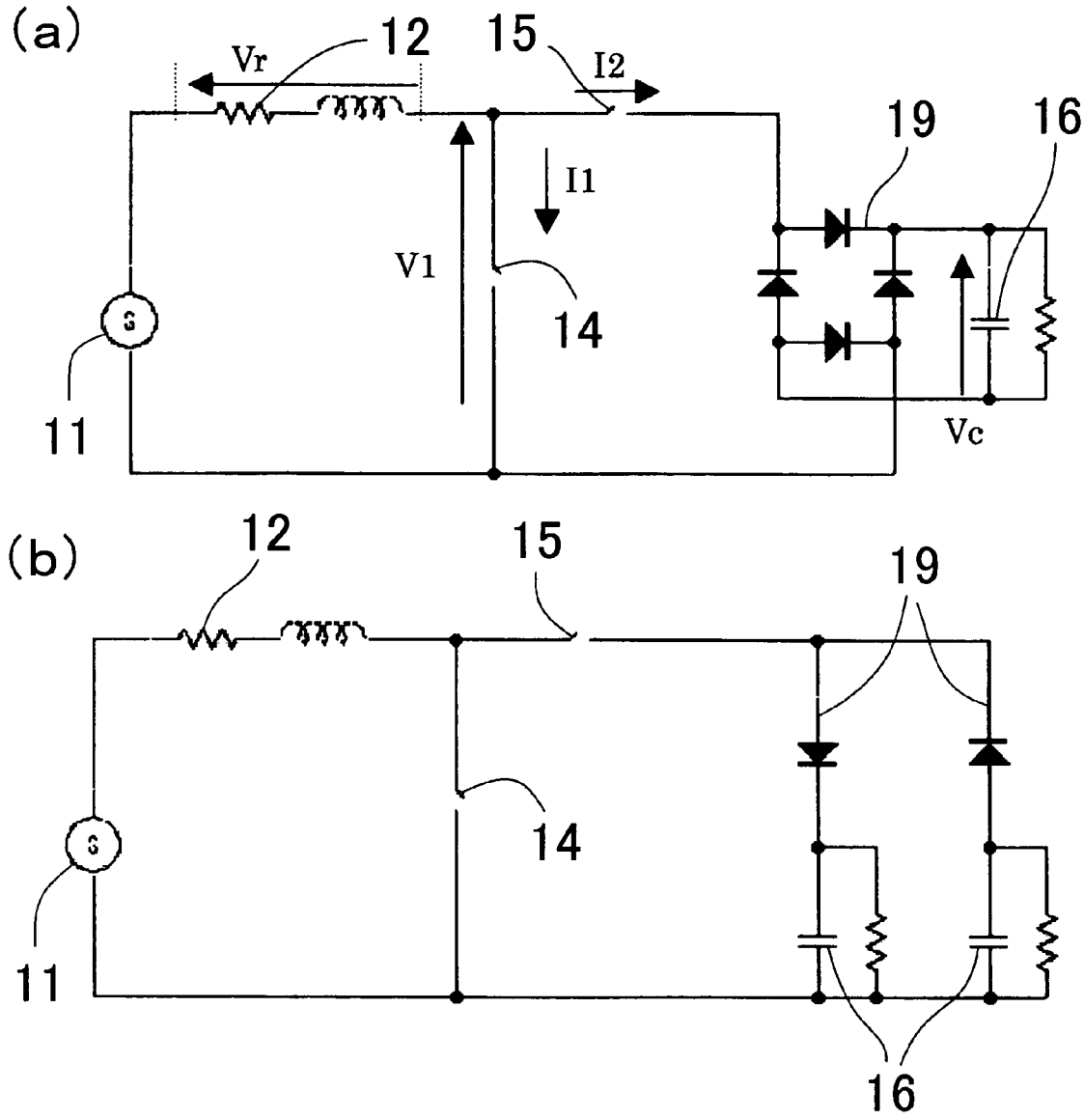

【Fig.20】
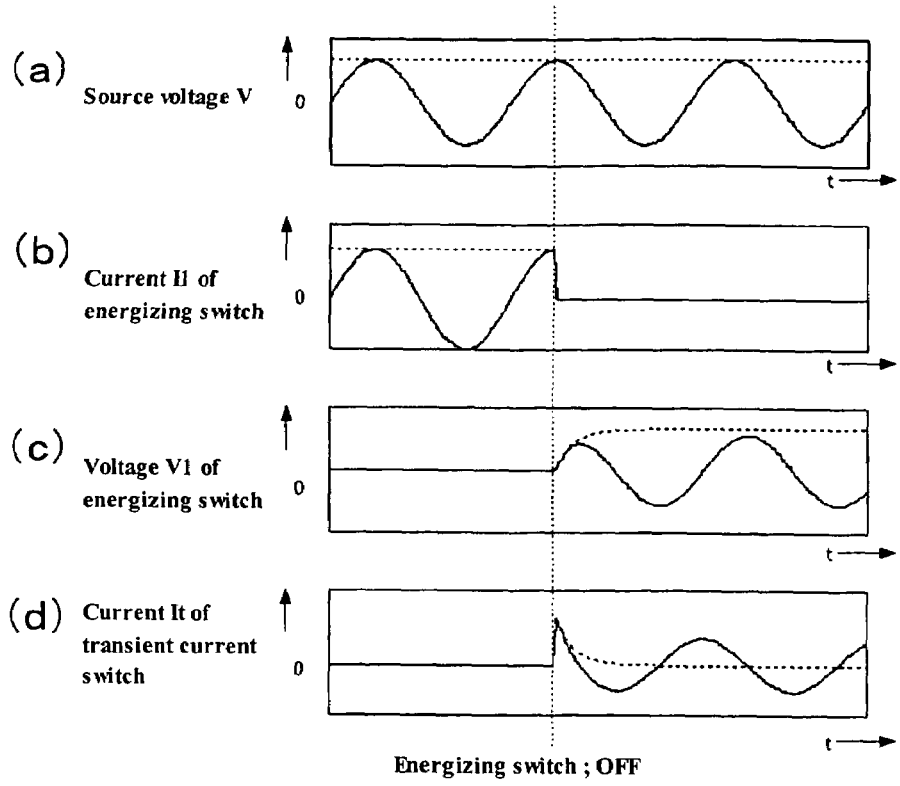
【Fig.21】
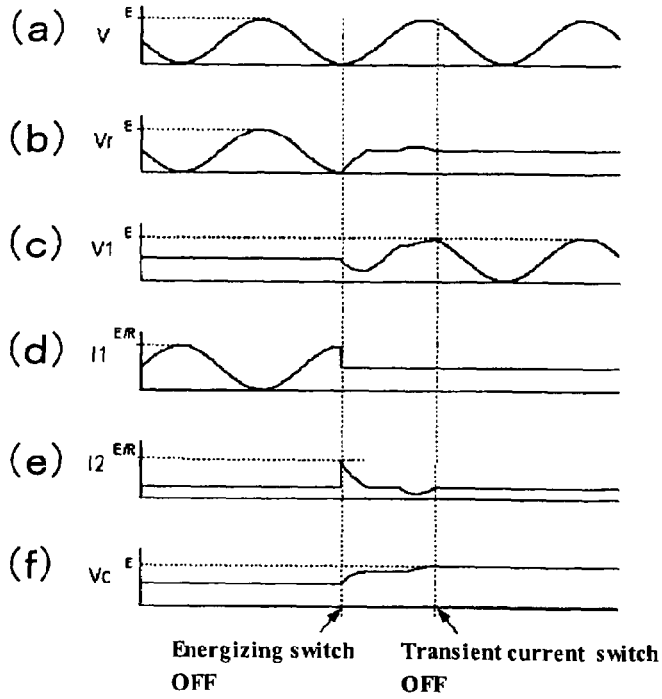

【Fig.22】
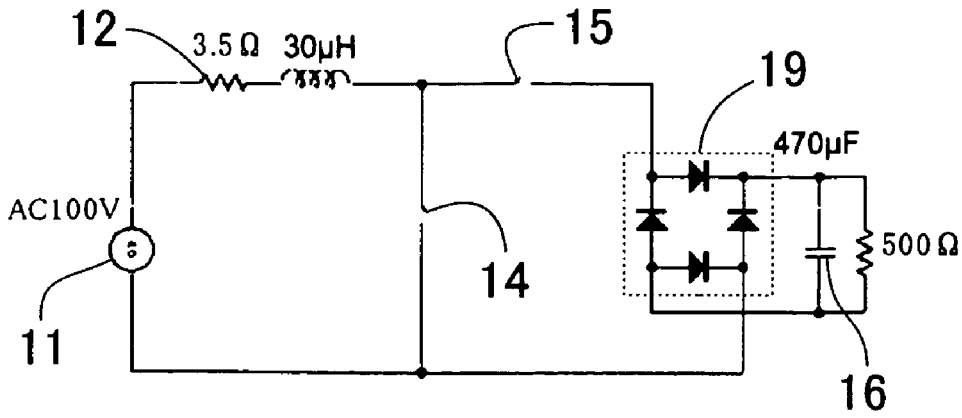
【Fig.23】
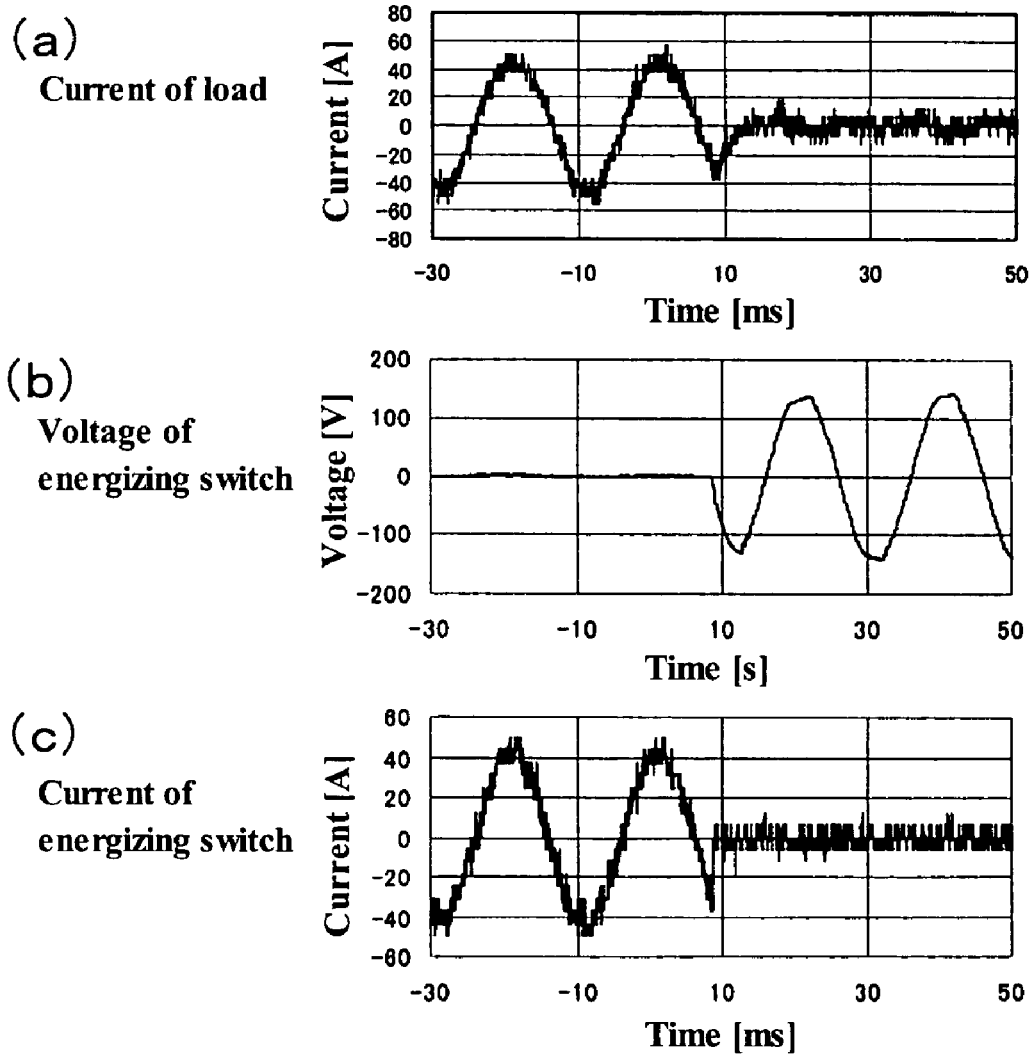

【Fig.24】
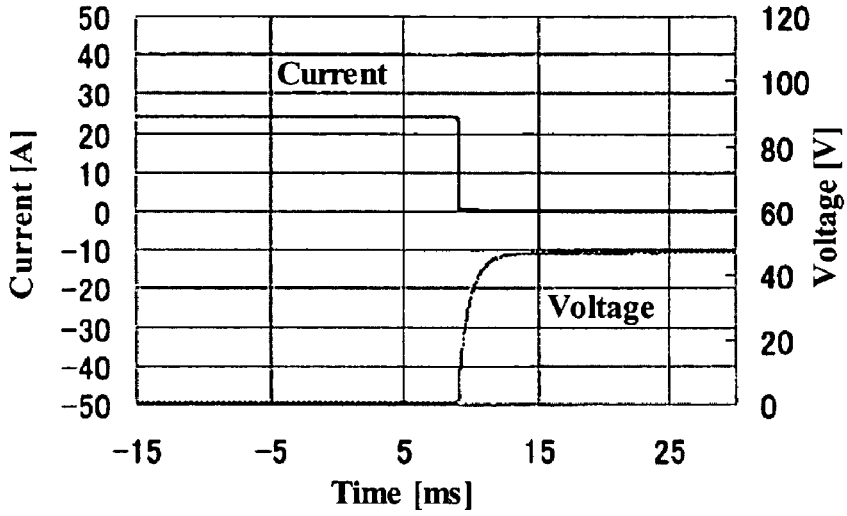
【Fig.25】
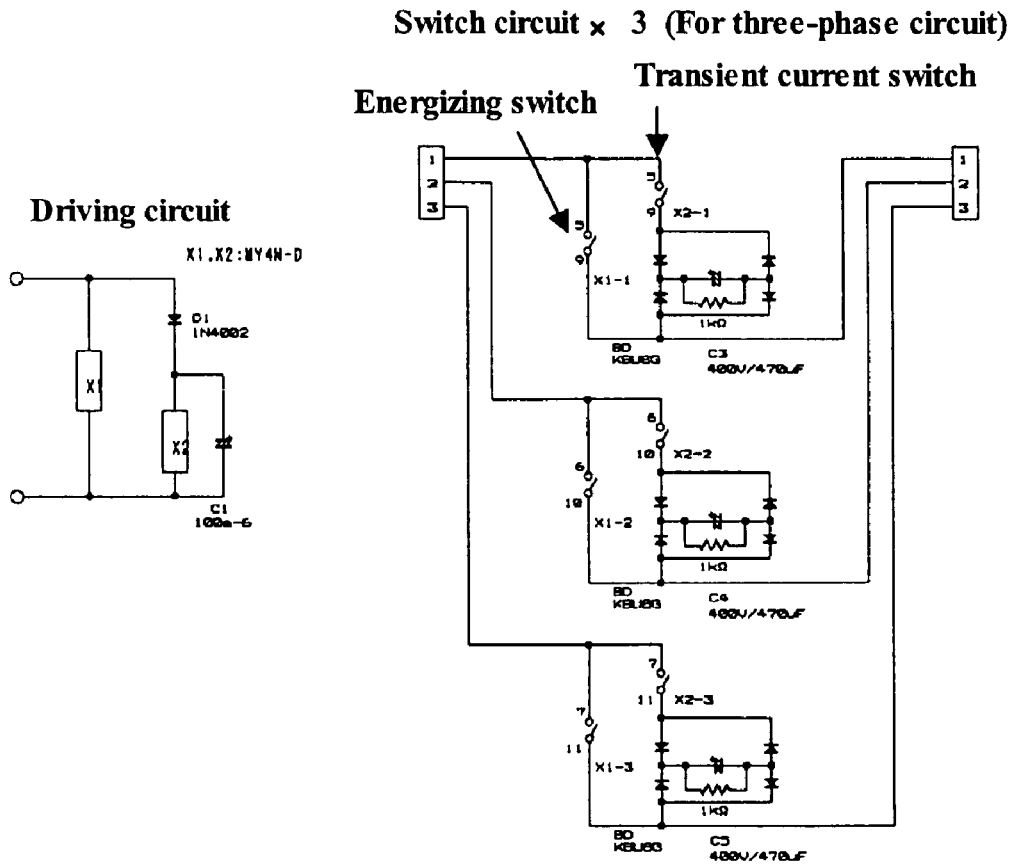

【Fig.26】
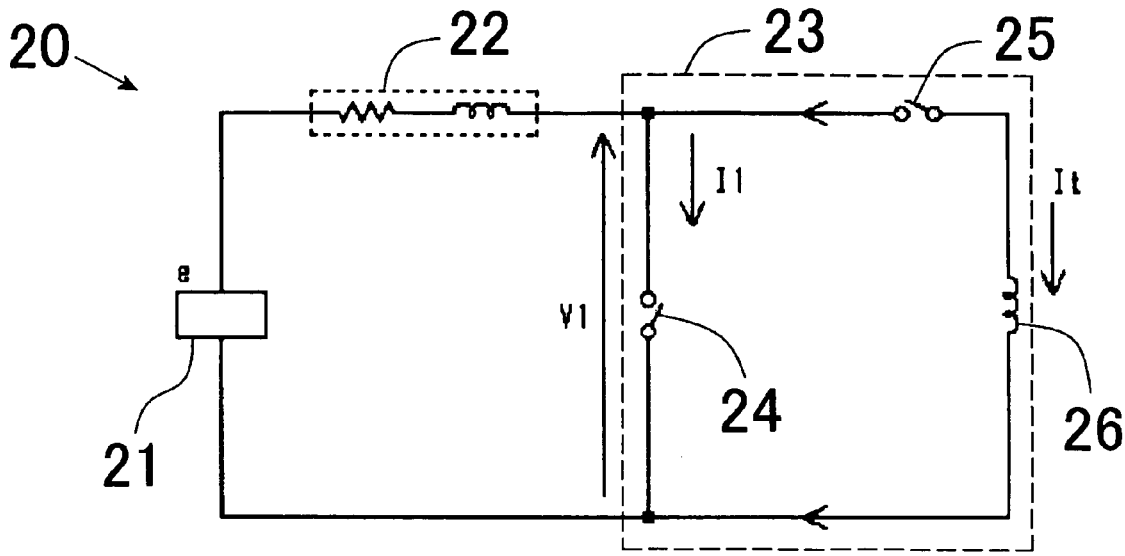

【Fig.27】
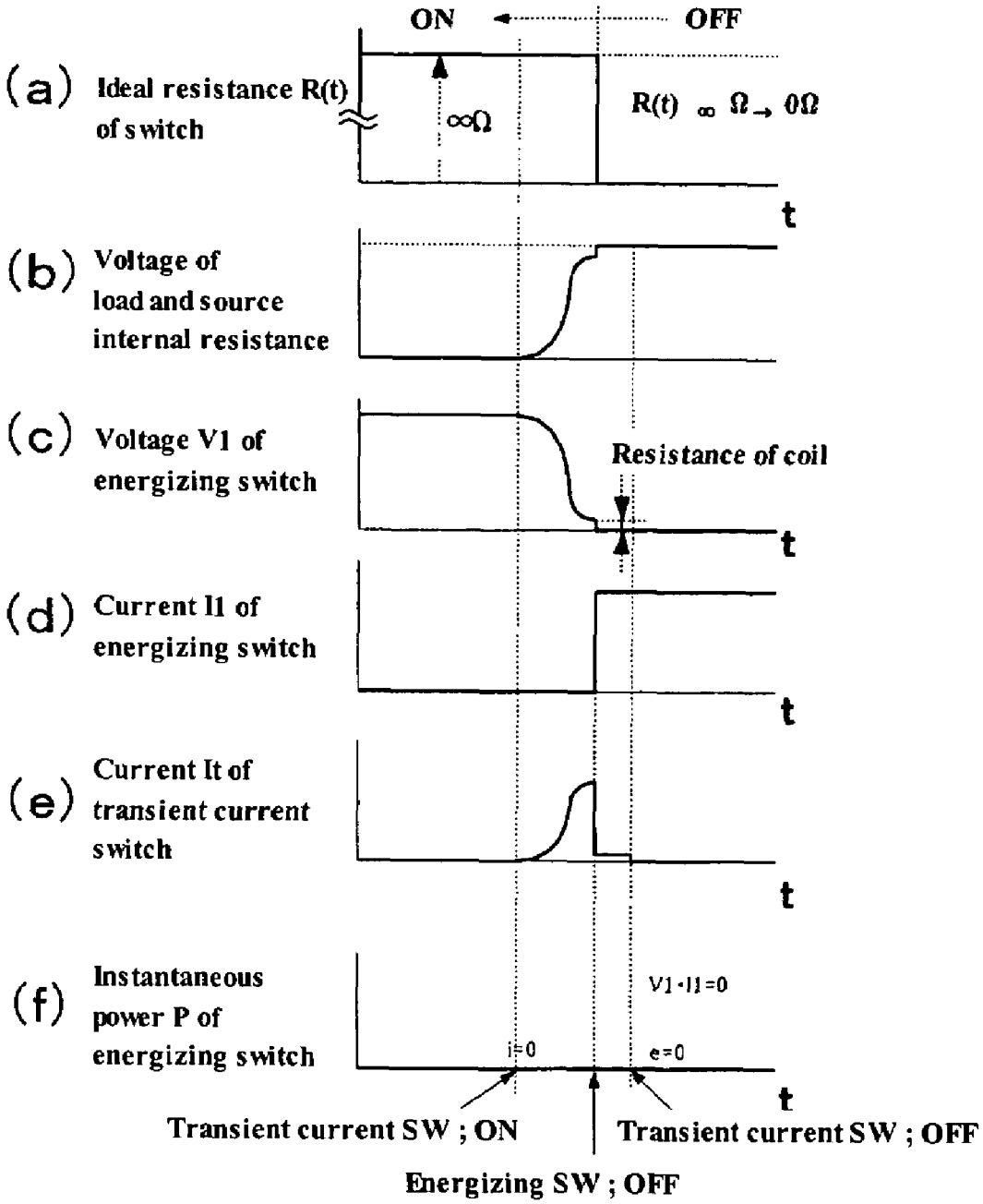

【Fig.28】
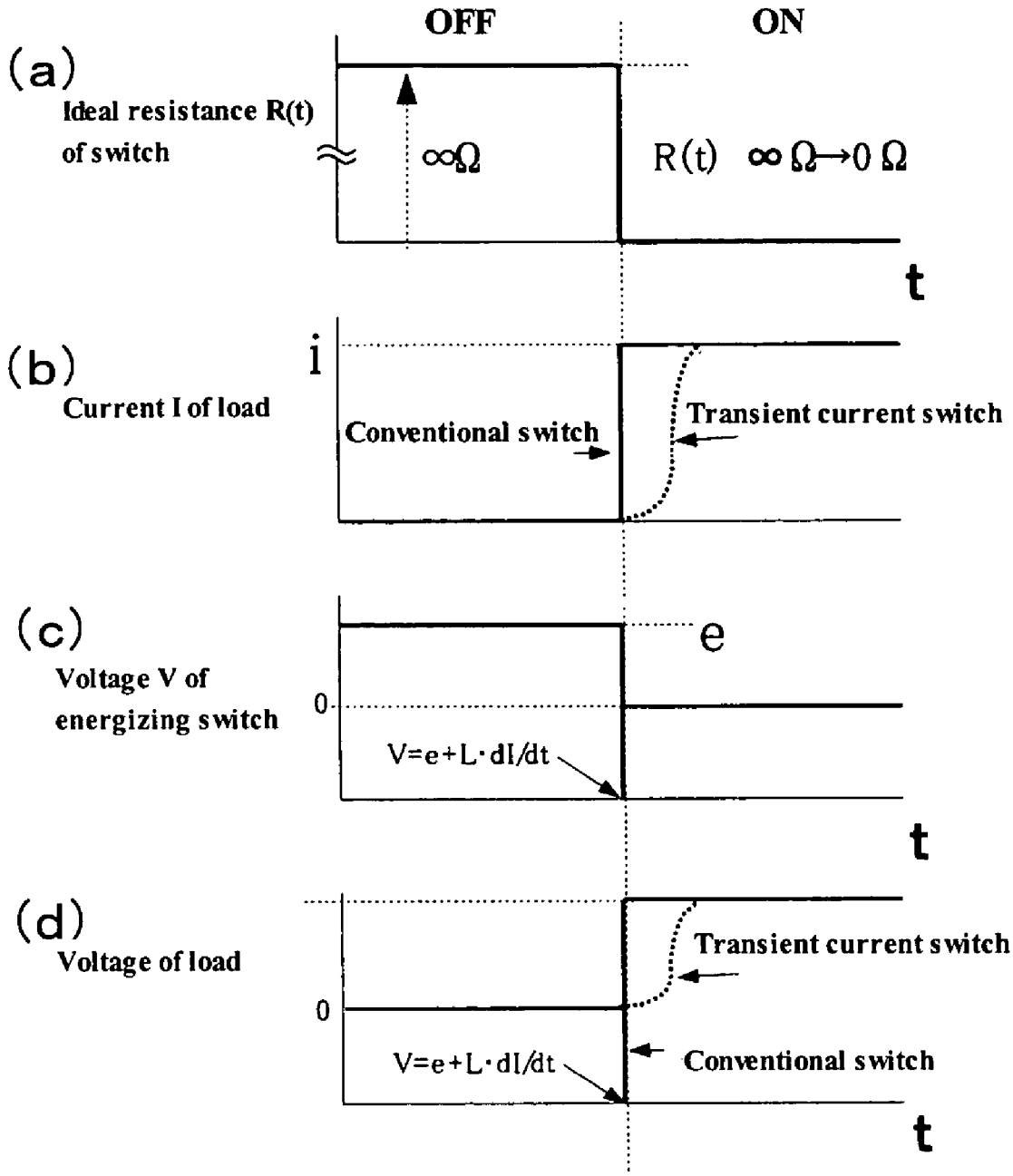

【Fig.29】
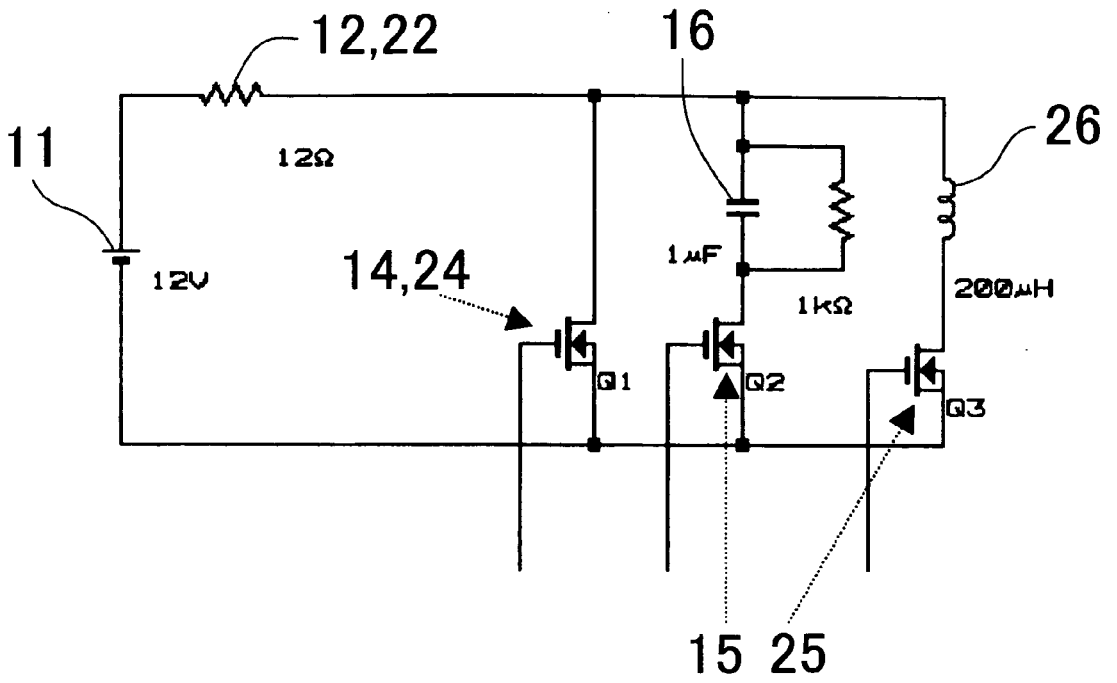

【Fig.30】
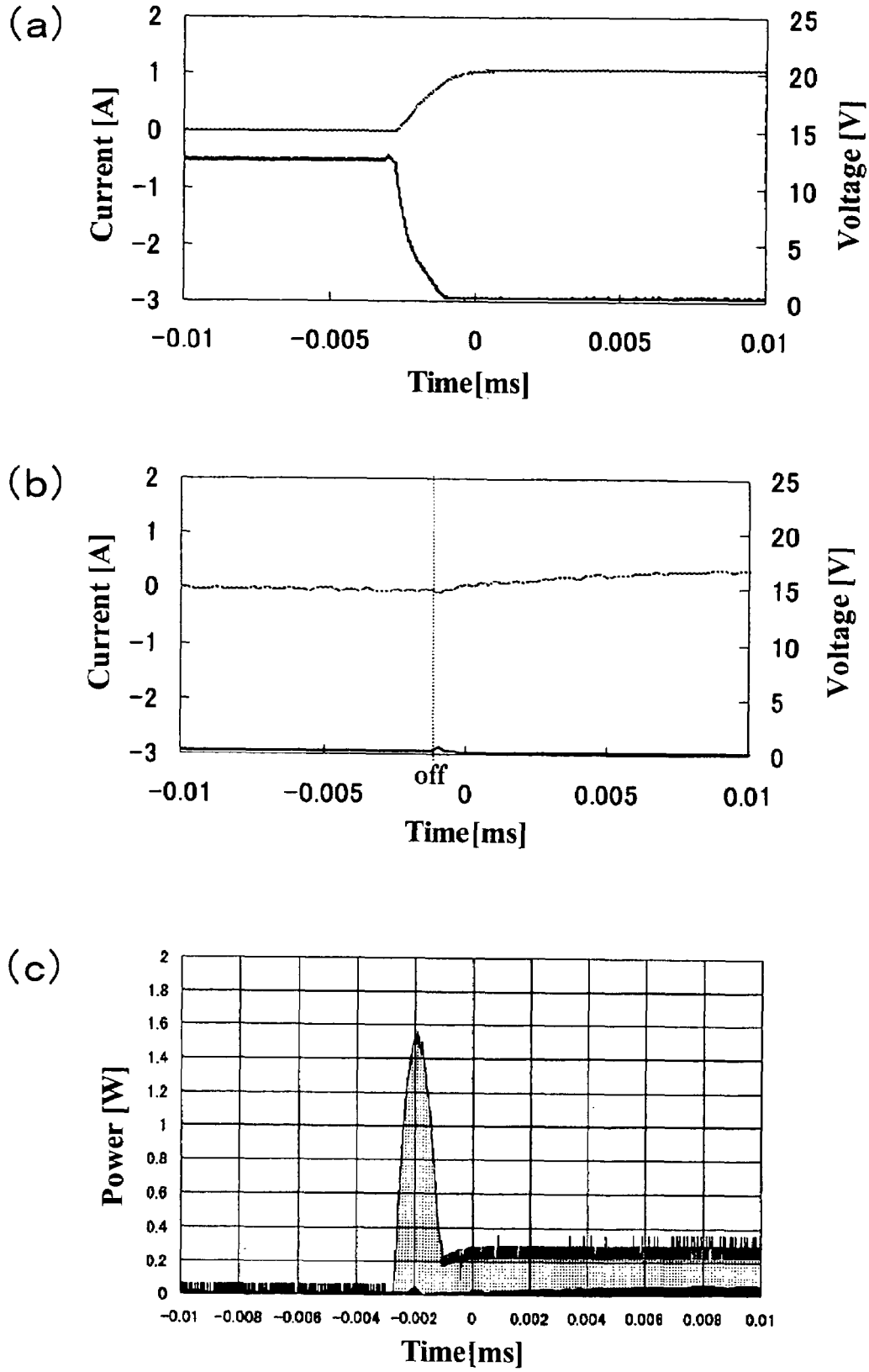

【Fig. 31】
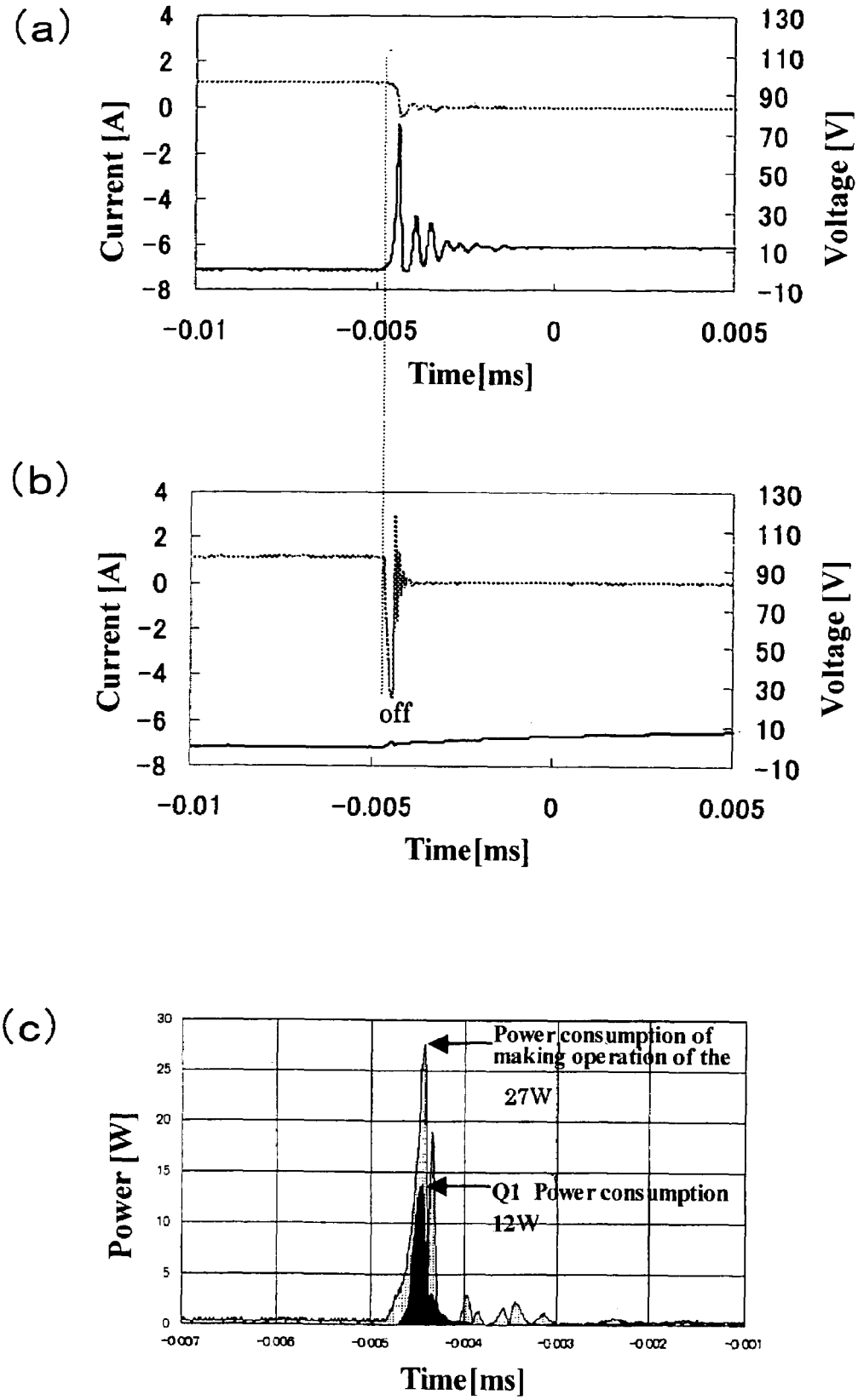

【Fig.32】
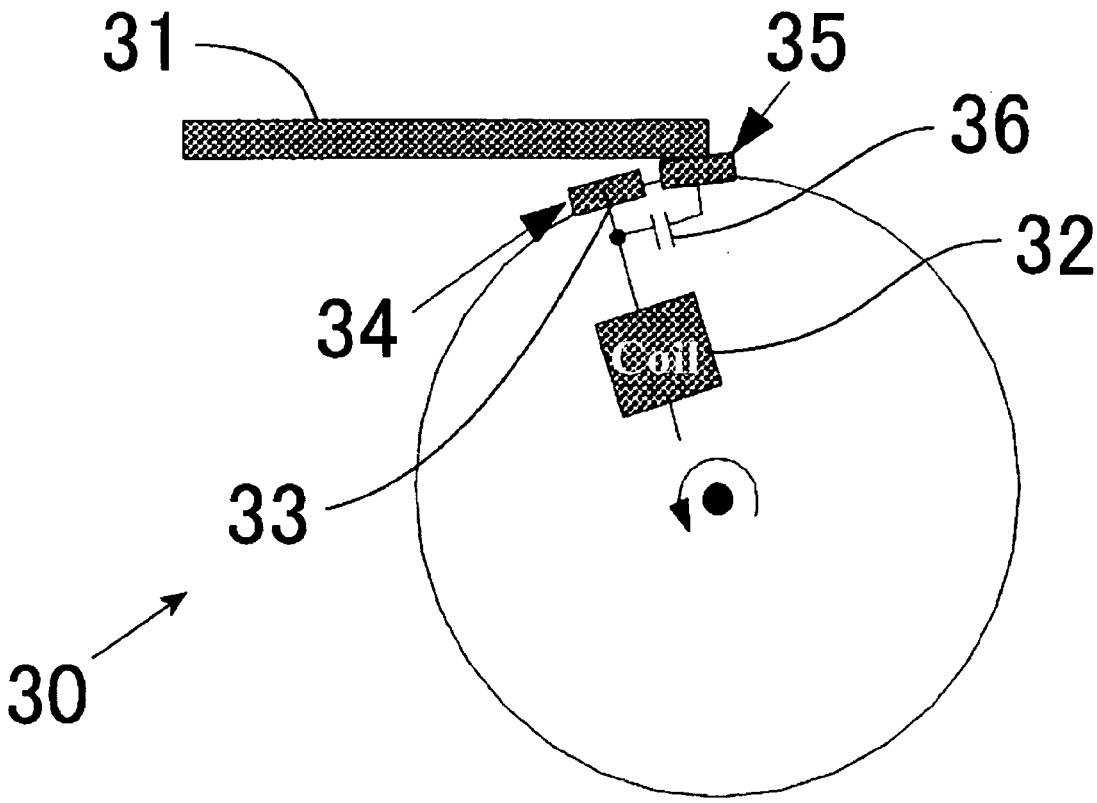

【Fig.33】
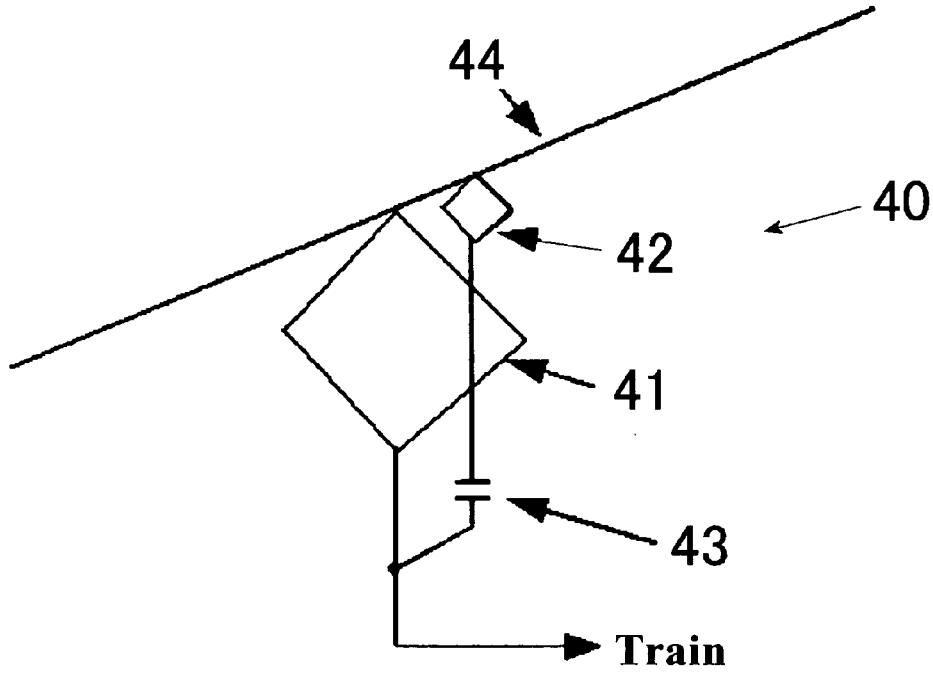
【Fig.34】
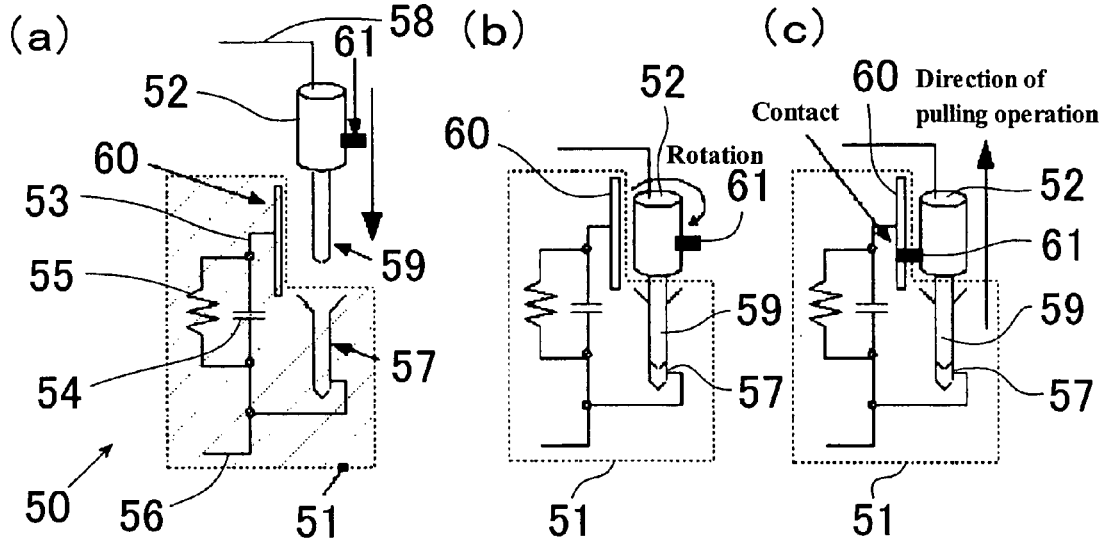

【Fig. 35】
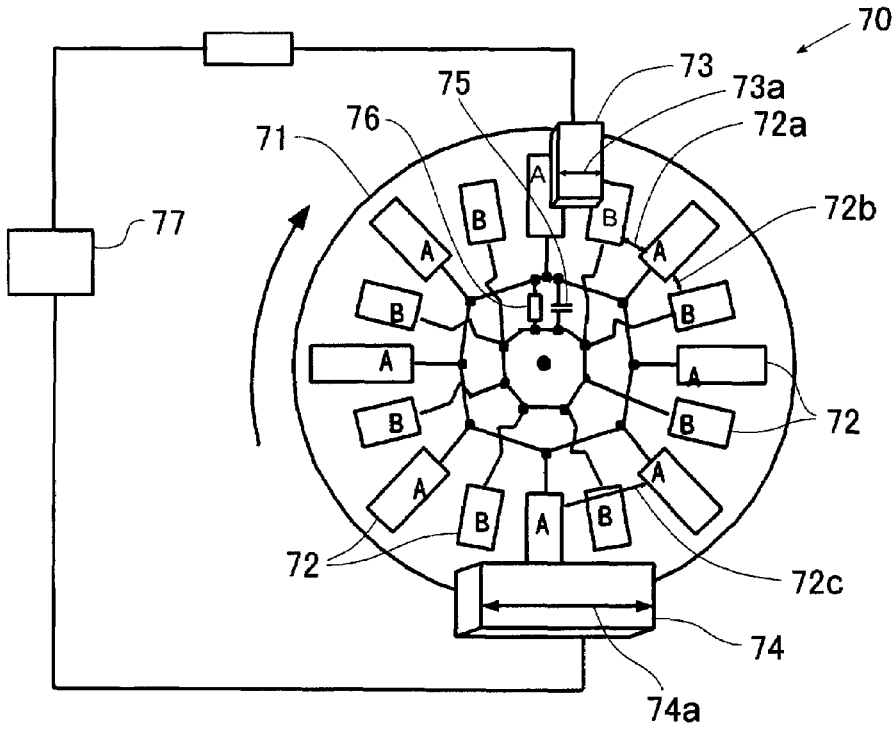
【Fig. 36】
Prior Art
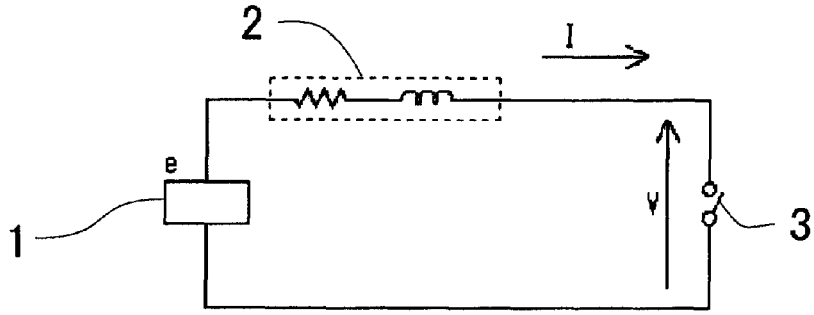

【Fig.37】
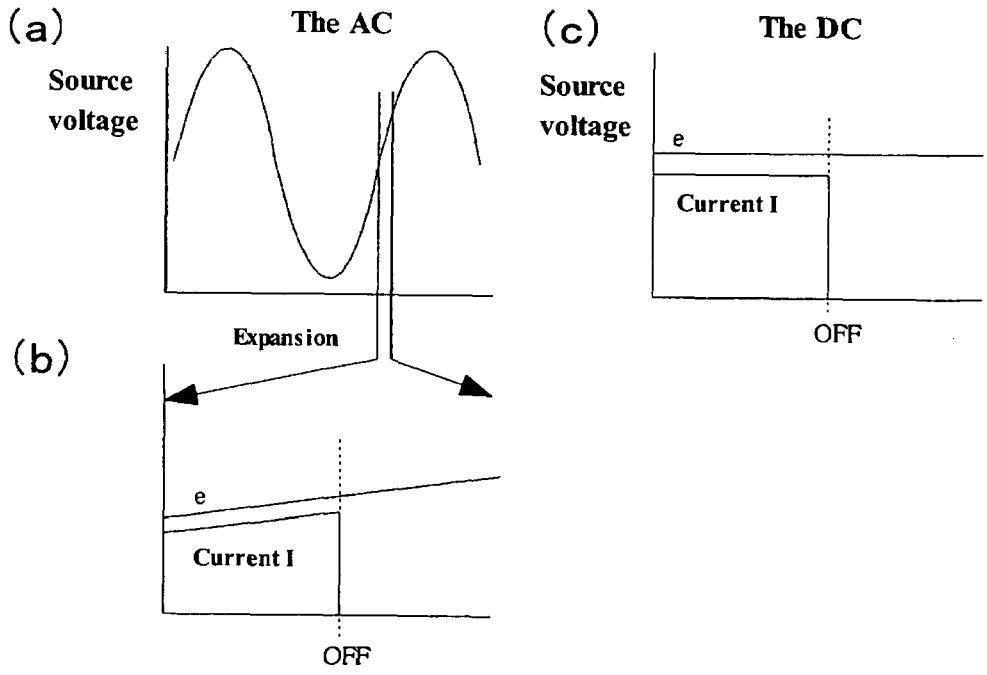
【Fig.38】
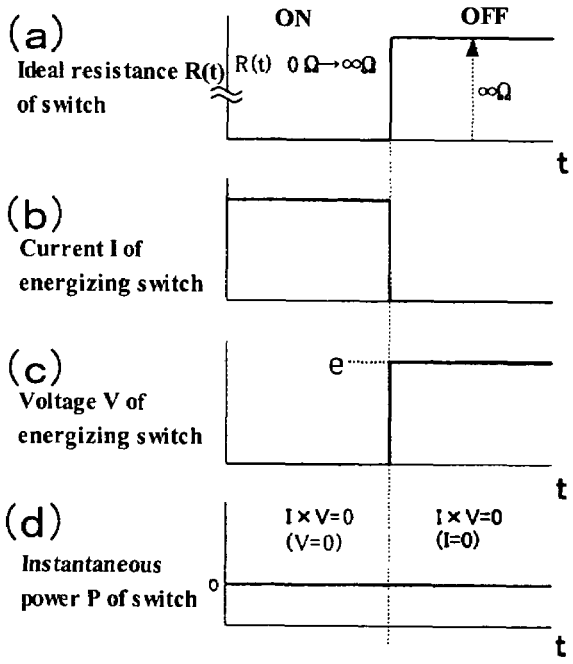

【Fig. 39】
Prior Art
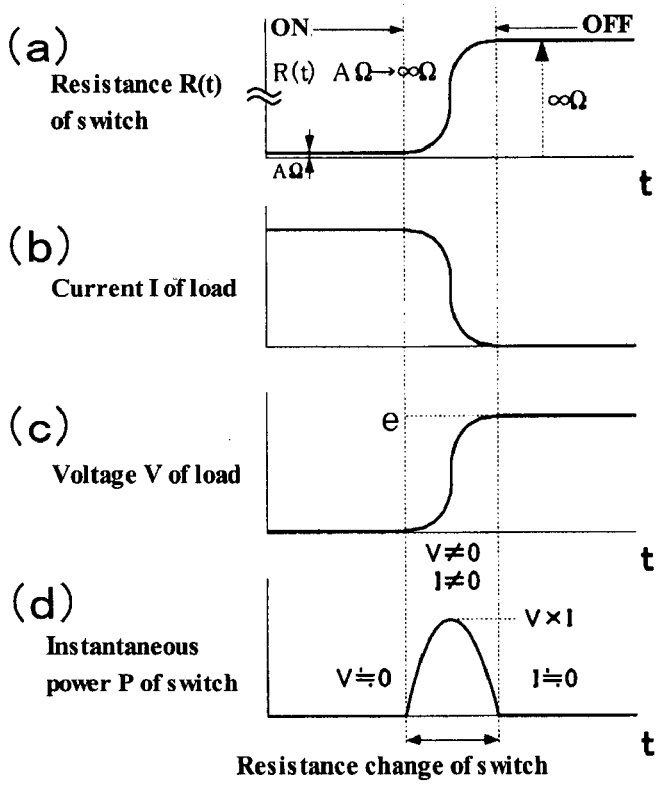
【Fig. 40】
Prior Art
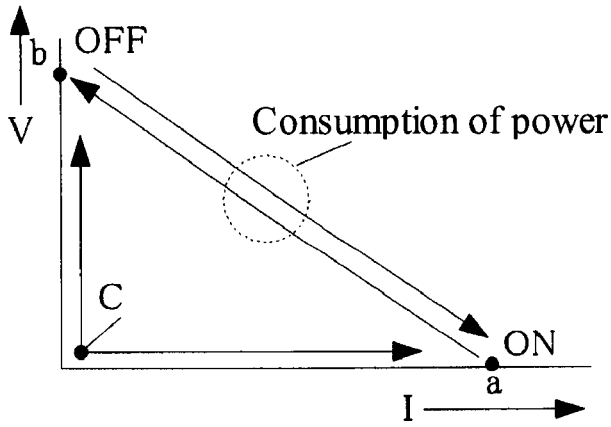

【Fig. 41】
Prior Art
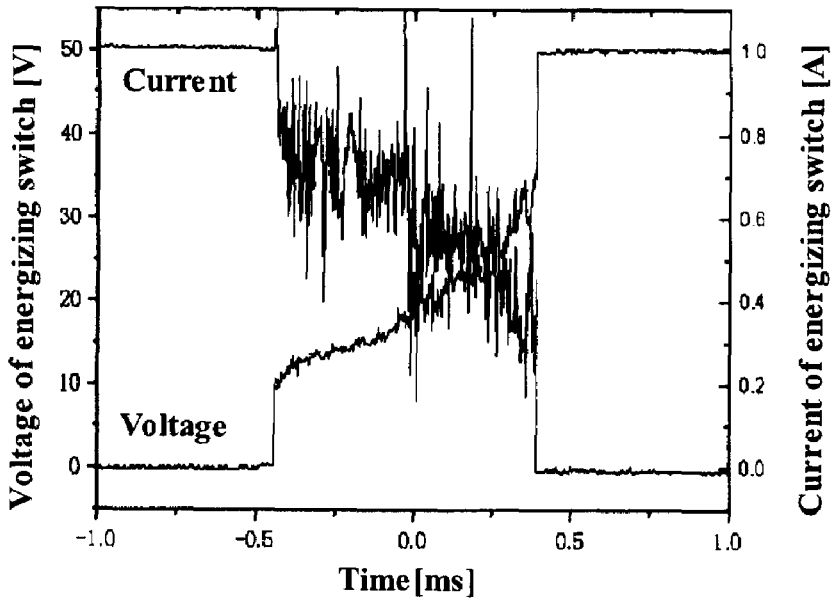

【Fig. 42】
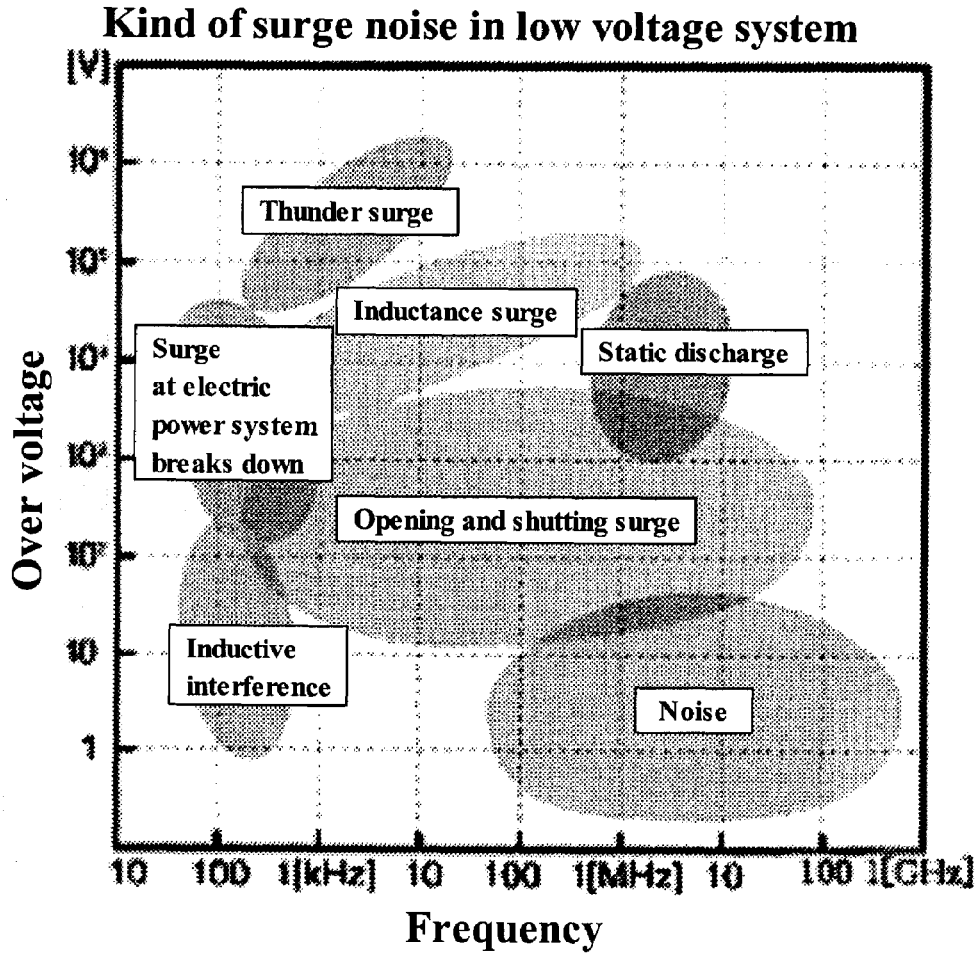
Frequency distribution of surge

【Fig. 43】
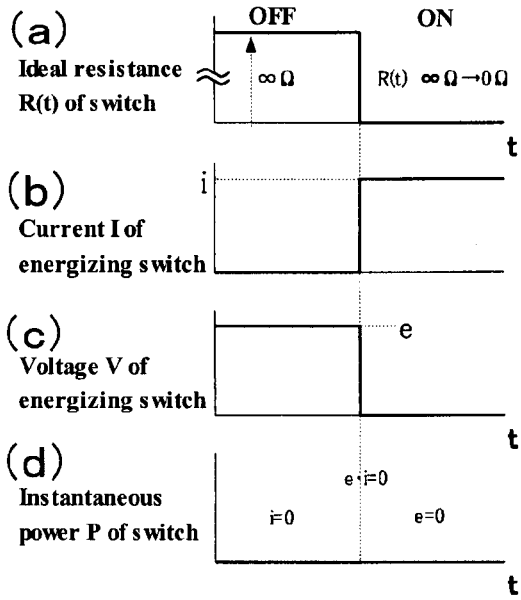
【Fig. 44】
Prior Art
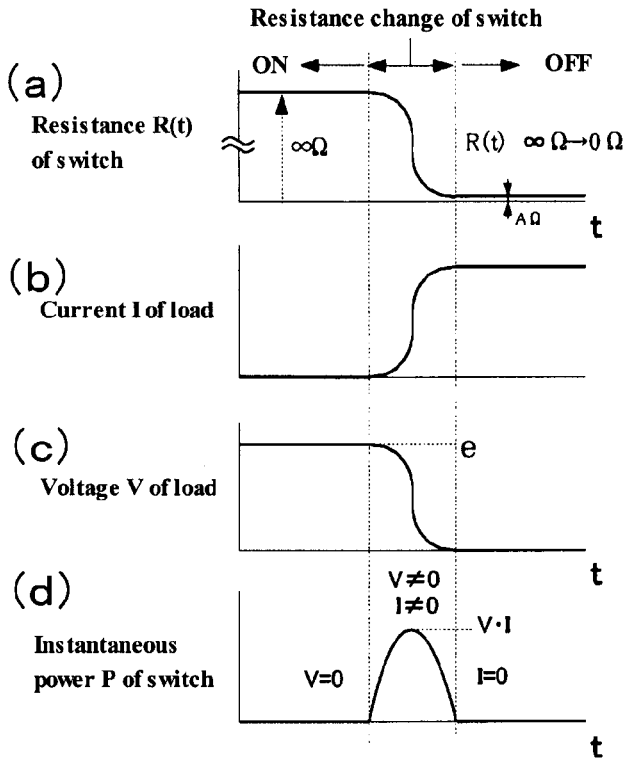

ELECTRIC CONTACT SWITCHING DEVICE AND POWER CONSUMPTION CONTROL CIRCUIT

TECHNICAL FIELD

This invention relates to an electric contact switching device, a power consumption control circuit, a DC motor, a pantograph device, a connector, and a pulse generation device.

BACKGROUND ART

An electric contact switching device that mechanically makes and breaks an electric current, a relay and a sliding contact, etc. has features such as very low energizing resistance in making state, very high isolating electric resistance in off-state, excellent isolation between a control signal and a making/breaking contact circuit, and comparatively cheap manufacturing costs, compared with semiconductor switches. Therefore, it is widely used to make and break connection in an electric circuit where a power supply, an actuator, and a sensor, etc. are included in all fields such as information instruments, industrial equipments, cars, and consumer electronics. Moreover, it is said that the production of mechanical switches and the relays will keep increasing in the future.

A conventional electric contact switching device consists of a pair of electric contacts for making and breaking operations of an electric switching circuit. During breaking operation of a pair of electric contacts, the contacting area of each electric contact becomes narrow, and the current concentrates into only one contacting point, a molten metal bridge between contact electrodes glows and the bridge lastly evaporates. Further current concentration will lead to metal evaporation.

For the making and breaking operation of the large current from the high voltage power supply using the conventional electric contact switching device, whenever the energizing contact current exceeds the minimum arc discharge ignition current (minimum arc current) and the contact voltage exceeds the minimum arc discharge ignition voltage (minimum arc voltage), the arc discharge is inevitably ignited (for example, see Non-Patent Documents 1 to 4). The minimum arc current and the minimum arc voltage are decided depending on the kind of the electric contact material. The arc discharge in the contact is accompanied by heat generation at the electrodes and transfer of the contact material, and decreases the reliability and the lifetime of the relay for the large current making/breaking operation.

The conventional electric contact switching device consists of a couple of contact electrodes made of Cu metal plated with Au, Ag, Pd, or Pt for example, of which the resistivity is very low, and the contact resistance is very low. In order to suppress the arc ignition, the new materials with a high melting temperature and low resistivity for example, have been studied, and an atmosphere gas and the operation in vacuum have also been studied. However, there would be no applicable technology of arc ignition suppression for the conventional contact. To suppress the arc discharge as much as possible, heating the contact electrodes or decreasing the heat conductivity of the electrodes has been studied. However, it negatively affects a driving coil of the relay and its effect is so limited. The contact electrodes are sometimes mechanically divided into plurals to improve the reliability of contacts, and such contacts are called twin contacts. It has two mechanical springs for the making/breaking operation and for preventing an insulator obstacle of the contact, but not to suppress the arc ignition. The relay with two couples of contacts with different contact material has been proposed. They are operated in a timely-controlled manner. One contact, which operates earlier than the other, has low electric resistance for energizing the currents and the other contact, which operates behind the other, has high endurance to welding due to the arc ignition (see Patent Document 1). However, in this case, the arc ignition could not be suppressed. There would be no solution to suppress the arc ignition for the conventional contact.

In order to improve the reliability, high performance, miniaturization and low price, the following five problems are chiefly examined for the electric contact of the large current and the high voltage. The difficulty of problems mainly comes from the arc discharge during the breaking operation.

(1) Welding of the electric contacts (2) Material transfer from the electrodes during breaking operations (3) Contact resistance increase by chemical reaction or surface roughness (oxidation and sulfuration, etc.) on the surface of the electrode (4) Miniaturization of the shape (5) Decrease of serge generation For the welding phenomenon of the electric contact in the above-mentioned (1), the molten metal bridge due to metal melting and metal evaporation generated by energizing current concentration into one spot is the main cause. It has a close correlation with the surface roughness and mass transfer of the electrodes due to the arc discharge. Because the arc current direction in a DC circuit is not changed, the problem for DC current switching is severer than for AC. The material transfer from the electrodes during the contact operations in the above-mentioned (2) is a complicated phenomenon of melting, evaporation, and the arc discharge. The contact resistance increase by the chemical reaction on the electrode surface in the above-mentioned (3) is induced by a rise in the metal temperature and an activated gas by the arc discharge. Miniaturization in the above-mentioned (4) of the contact device, the relay for example, is difficult due to the making/breaking mechanism against the arc discharge. The moving mechanism with a wide gap is inevitable to erase the arc discharge and a large contact force is necessary to overcome the roughened surface of the contact caused by the arc discharge for the low contact resistance. The serge generation in the above-mentioned (5) is induced inevitably at the breaking operation of the large current through an inductive load. When the large driving actuator breaks the large current with high velocity, bounce would occur and a complicated noise is generated due to a mechanical resonance of the moving electrode. Therefore, stable arc discharge, which starts as arc of the vaporized metal due to the arc discharge at the breaking operation and transfers to the arc of a surrounding gas, deteriorates the contact characteristics due to material consumption, material transfer and oxidation of the electrodes. If the arc ignition of the contact is suppressed, a lot of problems of the electric contact would be drastically solved.

Other than the electric contact switching device, generation of the arc discharge is also a problem for an armature of an electric motor or a pantograph of a train. For increasing the power consumption in the electrical equipments of cars, the higher voltage power supply is required for reducing electric power dissipation of a wiring. In the home electronics, a 300 V AC source would become popular for the higher power equipments. Therefore, the arc ignition of the electric contact becomes more important problem and the countermeasure has been studied eagerly.

As the arc discharge is estimated to be inevitable, metal composition, a thickness, a structure and a gap length of the contact electrodes are designed following to their deterioration factors to endure the target number of making/breaking cycles. Table 1 shows well known values of the minimum arc discharge current $I_m$ and the minimum arc discharge voltage $V_m$ (see Non-Patent Document 5). For the electric contact of Au metal, the minimum arc discharge current $I_m$ is 0.38 A, and the minimum arc discharge voltage $V_m$ is 15 V as shown in Table 1.

Table 1 shows the minimum arc electrical discharge currents and the minimum arc electrical discharge voltages in various metallic materials.

TABLE 1

Determinations of $I_m$ and $V_m$ in normal atmosphere, by various observers; Electrode diameter >> diameter of cathode spot; cf. Table (X, 3)

| | $I_m$ A | | | $V_m$ V | | | |
|---|---|---|---|---|---|---|---|
| Material | IVES | FINK | HOLM | IVES | GAULRAPP | FINK | HOLM |
| C | 0.02 | | 0.01 | 15.5 | | | 20 |
| Al | | | | | 18.3 | | 14 |
| Fe | | 0.73 | 0.35 to 0.55 | | | 8.0 | 13 to 15 |
| Ni | | 0.2 | 0.5 | | | 8.0 | 14 |
| Cu | | 1.15 | 0.43 | | 12.5 | 8.5 | 13 |
| Zn | | 0.36 | (0.1) | | 10.9 | 9.0 | 10.5 |
| Ag | | 0.9 | 0.4 | | 12.3 | 8 | 12 |
| Cd | | | (0.1) | | 9.8 | | 11 |
| Sb | | | | | 9.9 | | 10.5 |
| Ta | | 0.59 | | | | 8 | |
| W | 1.75 | 1.27 | 1.0 to 1.1 | | 15.2 | 10 | 15 |
| Pt | 0.67 | 1.0 | 0.7 to 1.1 | 15 | 15.3 | 13.5 | 17.5 |
| Au | 0.38 | 0.42 | 0.38 | 11.5 | 12.6 | 9.5 | 15 |
| Pb | | 0.52 | | | 9.1 | 7.5 | |

In order to quench the ignited arc discharge, a capacitor connected in parallel to the electric contact has been used as a quenching circuit. That is, the arc current at the contact is divided into the capacitor, the arc current becomes lower than the minimum arc discharge current, and the arc discharge disappears. For instance, it was reported that the minimum arc of Au is improved from 0.38 A to about 6 A by connecting the capacitor of 1 μF with the electric contact. However, there is a problem that the capacitor with the contacts decreases impedance for the AC current and is limited to the DC current. It means that isolation characteristics of the contacts decreases and the applicable circuits would be so limited. Adding to it, if the contacts are made during the capacitor is filled with high voltage charge, the rush current from the capacitor to the contact would raise the temperature of the metal contact and would cause welding of the contacts. To decrease the rush current from the capacitor to the contact, the resistance connected in series with the capacitor was proposed. However, the applicable circuits would be limited. A theoretical examination of the principle using the parallel capacitor to increase the minimum arc discharge current is insufficient, and the relation between the intercepted current and capacity of the capacitor and the high speed current change have not been theoretically examined.

A problem with the contact device other than the arc discharge is that the temperature near the contact surface rises by current concentration upon the breaking operation, leading to melting or evaporation of the metal. There is a theory, the "ϕ-Θ theory", which can presume the highest temperature $T_{max}$ near the contact surface from the contact voltage $V_C$ of the electric contact (for example, see Non-Patent Document 5). Provided that ρλ=LT (the Wiedemann-Franz law) is formed, where an isothermal surface temperature on both ends of a current path is the room temperature ($T_0$=300k) and the contact voltage is $V_c$, an approximate calculation of Formula (1) is obtained.

$$T_{max}=((V_c^2/4L)+T_0^2)^{1/2}\leqq 3200\cdot V_c[K] \quad (1)$$

Here, potential differences corresponding to a softening point temperature Ts, a melting point temperature Tm, and a boiling point temperature Tb of the current path material are called a softening voltage Vs, a melting voltage $V_m$, and a boil voltage $V_b$, respectively.

To overcome these problems, the arc quenching circuit comprising the capacitor connected in parallel to the electric contacts and another electric contact connected in series with the above-mentioned connectors with the capacitor was proposed. The two contacts synchronously perform the making or breaking operation (see Patent Document 2).

[Non-Patent Document 1] Tasuku Takagi, "Phenomenon of electrical discharge of arc of electric contact", Corona Publishing Co., Ltd, 1995

[Non-Patent Document 2] Atsuo Takahashi, "Research on generation area of point of contact arc", Nippon Institute of Technology research report, 1976, Separate volume 1, p. 65

[Non-Patent Document 3] "Relay technical booklet", Fujitsu component, 2002, p. 337

[Non-Patent Document 4] A. Hamilton and R. W. Sillars, "SPARK QUENCHING AT RELAY CONTACTS INTERRUPTING DC CIRCUITS", P.IEE, United States, 1949, Vol. 96, p. 64

[Patent Document 1] Japanese Unexamined Utility Model Publication (Kokai) No. 06-70143

[Non-Patent Document 5] R. Holm, "Electric Contact Theory and Applications ", United States, Springer-Verlag, New York, 1967, 4th ed., p. 283, p. 60

[Patent Document 2] Japanese Unexamined Patent Publication (Kokai) No. 09-245586

DISCLOSURE OF THE INVENTION

[Problems to be solved by the invention]

However, in the arc quenching circuit arrangement described in Patent Document 2, the electric contacts are connected in series with each other, so that, compared with the case where the number of the electric contact is one, the contact resistance doubles and the amount of energy losses and a calorific value double. For this reason, there is a problem that the power consumption increases. Additionally, since each electric contact needs the capacity which bears the energizing current, each electric contact becomes larger in size and the device cost increases. Since the supply voltage is certainly applied to the capacitor for arc quenching, it is necessary to use the pressure-resistant capacitor, which leads to the increase in the device cost and in the size.

From the view point of the above-mentioned problems, this invention is proposed to enable suppression of the arc ignition. Adding to it, the invention realizes the decrease in the device cost, miniaturization, and improvement in power dissipation for the electric contact switching device, the power consumption control circuit, the DC motor, the pantograph device, the connector, and the pulse generation device.

[Means for Solving the Problem]

In order to achieve the aforementioned object, an electric contact switching device according to a first aspect of the present invention is comprised of an energizing contact and a transient current contact with a capacitor connected in series with a switch, wherein the energizing contact and the transient current contact are connected electrically in parallel with each other, and the energizing contact and the transient current contact can do timely controlled making and breaking operations.

Even for the case of a complex circuit that consists of a power supply, a resistance, and an inductance, it is expressible by the series connection of an equivalent voltage power supply 1 and an equivalent impedance 2 using the Thevenin-Ho's theorem. Therefore, the switching operation can be examined in the equivalent circuit that combines them and switches 3 as shown in FIG. 36. A DC source, an AC source, and/or a pulse source are combined as the power supply 1. However, every source can be uniformly treated if paying attention to the rapid transient phenomenon of the making/breaking operation compared with the time change of the power supply 1 as shown in FIG. 37.

As shown in FIG. 38, the ideal switch 3, of which the resistance changes from zero to infinity and the response time is zero, does not cause the power consumption. However, as shown in FIG. 39, the actual switch 3 has non-zero resistance and has a gradient of resistance during the breaking operation. Therefore, the electric power is consumed in the contacts. As shown in FIG. 40, during breaking the contact current, the contact voltage rises from nearly zero to the source voltage. VI characteristics of the single switch 3 during the switching operation transfers from "a" to "b" in FIG. 40 and passes through a power generation region. FIG. 41 shows that a conventional electromagnetic relay has the arc discharge ignition with about half the voltage of the power supply voltage and also half the current of the load current during breaking the large current. It means the large power consumption in the contacts. If the inductance is neglected, the maximum power consumption occurs when the contact resistance is corresponding to the resistance of the load and the power supply 1.

In an electric contact switching device according to the first aspect of the present invention, the energizing contact and the transient current contact can do timely controlled making and breaking operations, so that a transient current from the power supply by the resistance change between the contacts can be sent through the capacitor via the transient current contact. Thereby, voltage drop by the internal resistance of the power supply, the resistance of the load, and the inductance is generated, and the voltage immediately after the current interception of the energizing contact is not raised. This state corresponds to voltage shifting from point "a" to point "c" in the state near zero in FIG. 40.

After the energizing contact is broken completely, the transient current turns to zero in an instant by breaking the transient current contact, and the voltage of the energizing contact rises to reach the supply voltage. This state corresponds to the shifting from point c to point b in FIG. 40. Thus, the electric contact switching device according to the first aspect of the present invention can control the power consumption in the energizing contact at the breaking operation. Moreover, since the voltage or current of the energizing contact can be made below the minimum arc discharge voltage or below the minimum arc discharge current, generation of the arc discharge can be prevented.

As shown in FIG. 42, when intercepting the current which flows through an inductive load, such as a motor and a lamp, as a source of electromagnetic noise and beginning to send the current quickly through the load, such as the capacitor, surge noise occurs by the rapid change in the current. In the electric contact switching device according to the first aspect of the present invention, at the time of the breaking operation of the energizing contact, by sending the transient current through the capacitor via the transient current contact, it can prevent the current which flows through the load from falling rapidly, and it can be made the loose change. Thereby, the surge noise can be controlled.

In the electric contact switching device according to the first aspect of the present invention, since what is necessary is to set up the time to make the transient current contact and apply the supply voltage to the capacitor only at the time of breaking the energizing contact, the small capacitor with low pressure resistance can be used, and reduction in the material cost and a miniaturization can be attained. By breaking the transient current contact except the time of breaking of the energizing contact, the electricity hardly flows into the transient current contact. For this reason, the transient current contact smaller than the electric contact for current interception can be used, so that reduction in the material cost and miniaturization can be attained.

As for the electric contact switching device according to the first aspect of the present invention, it is preferred to have an arrangement where, when breaking the energizing contact, the transient current contact is made. In this case, the transient current from the power supply by the resistance change between the contacts under the breaking operation of the energizing contact can be sent through the capacitor via the transient current contact. In this manner, the voltage drop by the internal resistance of the power supply, the resistance of the load, and the inductance is generated and the power surge immediately after current interception of the energizing contact is suppressed, so that the power consumption in the energizing contact at the time of breaking can be controlled.

As for the electric contact switching device according to the first aspect of the present invention, it is preferred that the electric resistance or the switch is connected in parallel with the capacitor. In this case, the capacitor can be initialized after breaking the transient current contact with the electric resistance or the switch.

In the electric contact switching device according to the first aspect of the present invention, the capacity of the capacitor is preferably set so that, when breaking the energizing contact and the current value which flows through the energizing contact falls below the minimum arc discharge current value of the energizing contact, the voltage between the energizing contacts may fall below the minimum arc discharge voltage value. In this case, since, when breaking the energizing contact, either of the current or the voltage between the energizing contacts is always below the minimum arc discharge current value or below the minimum arc discharge voltage value, generation of the arc discharge can be prevented reliably.

The electric contact switching device according to the first aspect of the present invention is the device wherein the capacitor is set with the capacity where the voltage between the energizing contacts does not exceed the voltage $V \approx Tm/3200$ (Tm: the melting point temperature of the energizing contact) or $V \approx Tb/3200$ (Tb: the boiling point temperature of the energizing contact). In this case, from Formula (1), since the voltage between the energizing contacts is suppressed to the voltage lower than the melting voltage or the boiling voltage, when breaking the energizing contact, it can prevent the bridge phenomenon and metal evaporation from occurring in the energizing contact.

As for the electric contact switching device according to the first aspect of the present invention, it is preferred to have means to break and make the transient current contact mechanically or electrically, based on a breaking/making signal of the energizing contact. In this case, using the breaking/making signal of the energizing contact as a trigger, the timing of breaking and making the transient current contact can be arbitrarily set up mechanically or electrically.

The electric contact switching device according to the first aspect of the present invention has a rectification circuit instead of the transient current contact, and the rectification circuit may rectify the current that flows into the capacitor to save the electric charge in the capacitor when the energizing contact is broken. Moreover, the electric contact switching device according to the first aspect of the present invention may have the transient current contact connected in series with the rectification circuit. In this case, also when the speed of the change in supply voltage is higher than that of the breaking/making operation of the energizing contact, the charge can be saved in the capacitor when the energizing contact is broken, and it can prevent the steady current other than the transient current from flowing into the capacitor. For this reason, the transient current switch can be broken at a current zero state. Furthermore, by the rectification circuit, specification of the current direction of the capacitor becomes unnecessary in the case of the DC power supply, so that the capacitor with polarity such as an electrolytic capacitor can be used.

An electric contact switching device according to a second aspect of the present invention has the energizing contact and the transient current contact with the inductance connected in series with the transient current contact, wherein the energizing contact and the transient current contact are connected electrically in parallel with each other, and the energizing contact and the transient current contact can do timely controlled making and breaking operations.

As shown in FIG. 43, the power consumption is not produced with a switch 3 ideal in the circuit shown in FIG. 36. However, with the actual switch 3, as shown in FIG. 44, the contact resistance is not zero and it changes in time before complete making. Thus, the power is consumed between the electric contacts. In the electric contact switching device according to the second aspect of the present invention, the energizing contact and the transient current contact can do timely controlled making and breaking operations, so that the transient current of the power supply which flows through the transient current contact can be restored to a regular value, and, after the voltage between the energizing contacts turns to substantially zero, the energizing contact can be made. Thereby, the power consumption in the energizing contacts at the time of making can be controlled.

In the electric contact switching device according to the second aspect of the present invention, at the time of making the energizing contact, by sending the transient current through the inductance via the transient current contact, so that it can prevent the current from flowing through the load rapidly, and it can be made a loose change. Thereby, the surge noise can be controlled.

As for the electric contact switching device according to the second aspect of the present invention, it is preferred to have an arrangement where, when making the energizing contact, the transient current contact is made. In this case, the transient current of the power supply which flows through the transient current contact can be restored to the regular value, and, after the voltage between the energizing contacts turns to substantially zero, the energizing contacts can be made. Thereby, the power consumption in the energizing contact at the time of making can be controlled.

In the electric contact switching device according to the first and second aspects of the present inventions, the energizing contact and the transient current contact may be constituted by a semiconductor switch. In this case, it is effective when breaking and making the energizing contact and the transient current contact at high speed. The semiconductor switch is constituted by such as a transistor, an FET, or a diode. When it is especially constituted by a power MOSFET which can deal with the large current, generation of heat at the time of making and breaking the switch can be suppressed.

A power consumption control circuit according to the first aspect of the present invention has the power supply, the load, and the electric contact switching device according to the first aspect of the present invention, wherein the load and the power supply are connected, the electric contact switching device is connected in series with the load, and wherein it has a configuration that, when breaking the energizing contact, the transient current contact is made so that the transient current from the power supply is sent through the capacitor, the voltage drop by the internal resistance of the power supply or the load is generated, and the power surge of the energizing contact is suppressed.

In the power consumption control circuit according to the first aspect of the present invention, when the energizing contact is broken, the transient current from the power supply is sent through the capacitor by making the transient current contact, and the voltage drop by the internal resistance of the power supply or the load is generated and the power surge of the energizing contact is suppressed, so that the power consumption in the energizing contact at the time of breaking can be controlled. Moreover, since the voltage or current of the energizing contact can be made below the minimum arc discharge voltage or below the minimum arc discharge current, generation of the arc discharge can be prevented.

In the power consumption control circuit according to the first aspect of the present invention, at the time of breaking the energizing contact, by sending the transient current through the capacitor via the transient current contact, so that it can prevent the current which flows through the load from falling rapidly, and it can be made a loose change. Thereby, the surge noise can be controlled.

In the power consumption control circuit according to the first aspect of the present invention, by setting up the time to make the transient current contact and apply the supply voltage to the capacitor only at the time of breaking the energizing contact, the small capacitor with low pressure resistance can be used, and reduction in the material cost and miniaturization can be attained. By breaking the transient current contact except the time of breaking the energizing contact, the electricity hardly flows into the transient current contact. For this reason, the transient current contact smaller than the electric contact for current interception can be used, so that reduction in the material cost and miniaturization can be attained.

The power consumption control circuit according to the second aspect of the present invention has the power supply, the load, and the electric contact switching device according to the second aspect of the present invention, wherein the load and the power supply are connected, the electric contact switching device is connected in series with the load, and wherein it has a configuration that, after making the transient current contact and the transient current of the power supply which flows through the transient current contact is restored to the regular value, the energizing contact is made.

In the power consumption control circuit according to the second aspect of the present invention, after making the transient current contact and the transient current of the power supply which flows through the transient current contact is restored to the regular value, it makes the energizing contact, so that it can control the power consumption in the energizing contact at the time of making. Moreover, at the time of making the energizing contact, the transient current is sent through the inductance via the transient current contact, so that it can prevent the current from flowing through the load rapidly, and it can be made a loose change. Thereby, the surge noise can be controlled.

A DC motor according to the present invention is a DC motor which contacts by turns a pair of brushes connected to the power supply with a pair of commutators provided on both ends of an armature, respectively, to send the direct current through the armature placed in a magnetic field, and to rotate the armature in response to an electromagnetic force, wherein, for the commutators to be electrically connected electrically in parallel with each other when contacted to the brush, each commutator has two contacts aligned in the direction of rotation and the capacitor connected in series with the contact at the back side of the direction of rotation.

Since the DC motor according to the present invention contacts the contact at the back side when the brush which contacts the contact at the front side of the direction of rotation separates from the contact by rotation of the commutator, it can send the transient current from the power supply through the capacitor. Thereby, the voltage drop by such as the internal resistance of the power supply is generated and the power surge between the brush and the contact at the front side is suppressed, so that generation of the arc discharge therein can be prevented and the power consumption can be controlled.

A pantograph device according to the present invention is a pantograph device for energization by contacting an overhead wiring, which has a pair of the pantographs and the capacitors, wherein the respective pantographs are arranged to be connected electrically in parallel with each other when contacted to the overhead wiring, and the capacitor is connected in series with one of the pantographs.

In the pantograph device according to the present invention, as long as one pantograph contacts the overhead wiring while the other pantograph is separated from the overhead wiring by such as vibration, it can send the transient current from the overhead wiring through the capacitor. Thereby, the voltage drop by such as the internal resistance of the overhead wiring is generated and the power surge between the overhead wiring and the other pantograph is suppressed, so that generation of the arc discharge therein can be prevented and the power consumption can be controlled.

A connector according to the present invention is a connector to conduct a socket side energizing line connected to a socket and a plug side energizing line connected to a plug by connecting the socket and the plug, wherein the connector has a socket side branch line, a plug side branch line, and the capacitor, and wherein the socket side energizing line has a socket side energizing contact, the socket side branch line is branched from the socket side energizing line and has a socket side transient current contact, the plug side energizing line has a plug side energizing contact, the plug side branch line is branched from the plug side energizing line and has a plug side transient current contact, and the capacitor is disposed either on the socket side branch line or the plug side branch line, and wherein the socket side energizing contact and the plug side energizing contact are made when the socket is connected to the plug, and the socket side transient current contact and the plug side transient current contact are made when the socket is connected to or removed from the plug, and wherein, while maintaining the making state, the socket side energizing contact and the plug side energizing contact are broken to remove the socket from the plug.

In the connector according to the present invention, when removing the socket from the plug, the socket side energizing contact and the plug side energizing contact are broken while the socket side transient current contact and the plug side transient current contact are in making state, so that it can send the transient current from the power supply through the capacitor. Thereby, the voltage drop by such as the internal resistance of the power supply is generated and the power surge between the socket side energizing contact and the plug side energizing contact is suppressed, so that generation of the arc discharge therein can be prevented and the power consumption can be controlled.

A pulse generation device according to the present invention has a rotor with a plurality of rotating electrodes, contact electrodes, and capacitors, wherein the respective rotating electrodes are separated by an insulator from each other and disposed symmetrically for a rotating axis of the rotor, each rotating electrode is constituted by a front side electrode placed at the front side of the direction of rotation of the rotor and a back side electrode placed at the back side of the direction of rotation, the front side and back side electrodes are connected electrically in parallel with each other to the power supply, and wherein the contact electrode is disposed so as to contact the respective rotating electrodes sequentially and intermittently during rotation of the rotor in the order corresponding to the front side electrode, the front and back side electrodes, and the back side electrode, and wherein the capacitor is connected in series with the respective back side electrode.

The pulse generation device according to the present invention can generate a current pulse train or a voltage pulse train, and can be used for such as an inverter device. Since the contact electrode is provided so as to contact the front side and back side electrodes of the respective rotating electrodes in the order corresponding to the front side electrode, the front and back side electrodes, and the back side electrode, when the contact electrode separates from the front side electrode, the transient current from the power supply can be sent through the capacitor. Thereby, the voltage drop by such as the internal resistance of the power supply is generated and the power surge between the contact electrode and the front side electrode is suppressed, so that generation of the arc discharge therein can be prevented and the power consumption can be controlled.

In the electric contact switching device according to the first and second aspects of the present inventions, as well as the power consumption control circuit according to the first and second aspects of the present inventions, by analyzing a waveform of the current flowing through the transient current contact or a voltage waveform of the capacitor or the coil connected in series, the property of the circuit in the state near an operating condition can be presumed as an equivalent circuit as shown in FIG. 1. In this case, while the energizing contact is made and the circuit is operating, the current in the transient current contact or the voltage of the capacitor or the coil is not generated, and the circuit which detects the current or the voltage is not affected and does not give the effect. Meanwhile, since the transient current contact is broken when the energizing contact is broken and the current is intercepted, the current in the transient current contact or the voltage of the capacitor or the coil is not generated as well, and that the circuit which detects the current or the voltage is not affected and does not give the effect.

[Advantage of the Invention]

According to the present invention, it can provide the electric contact switching device, the power consumption control circuit, the DC motor, the pantograph device, the connector, and the pulse generation device which can attain reduction in the material cost and miniaturization while preventing occurrence of the arc discharge.

BRIEF DESCRIPTION OF THE DRAWINGS

FIG. 1 shows a power consumption control circuit in the first embodiment of this invention;

FIG. 2 shows an explanation chart of a power consumption control circuit shown in FIGS. 1 and 26: (a) Time chart of a driving signal for making and breaking operation of an energizing contact; (b) Time chart of making and breaking operation of the energizing contact; (c) Time chart of a transient current contact during making operation of the energizing contact; (d) Time chart of the transient current contact during breaking operation of the energizing contact;

FIG. 3 shows responses of the power consumption control circuit shown in FIG. 1 during breaking operation: (a) Time response of a power supply voltage; (b) Time response of an energizing current; (c) Time response of a transient contact current;

FIG. 4 shows means of making and breaking time controlled operation for the power consumption control circuit shown in FIG. 1: (a) Example of changing a distance between contact electrodes; (b) Example of changing elasticity of contact arms; (c) Example of changing mass of contact arms;

FIG. 5 shows an arrangement of rotation type making and breaking contact operation for the power consumption control circuit shown in FIG. 1;

FIG. 6 shows push button type making and breaking contact operation for the power consumption control circuit shown in FIG. 1: (a) Arrangement; (b) Experimental response of the energizing contact current and voltage during breaking operation of the energizing contact;

FIG. 7 shows making and breaking contact operation of an electromagnetic relay for the power consumption control circuit shown in FIG. 1: (a) Switching circuit; (b) Electric circuit of driving current circuit for making/breaking operation; (c) Photograph of an arrangement;

FIG. 8 shows a time response of the current and voltage of the energizing contacts shown in FIG. 7 during its breaking operation;

FIG. 9 shows surface photographs of the contacts after 100 times making/breaking operations in the circuit shown in FIG. 7;

FIG. 10 shows a time dependence of a transient contact resistance during breaking operation for the power consumption control circuit shown in FIG. 1;

FIG. 11 shows a transient contact resistance shown in FIG. 10 measured by a conventional electromagnetic relay;

FIG. 12 shows an equivalent electric circuit for transient analysis with the contact resistance instead of the energizing contact of the power consumption control circuit shown in FIG. 1;

FIG. 13 shows a calculation method of $\Delta t$ for the current and voltage of the energizing contact during its breaking operation using the equivalent circuit shown in FIG. 12;

FIG. 14 shows dependency of anodized values of $\Delta t$ and the measured arc ignition probability on the contact current: (a) No capacitor; (b) Capacitor of 1 nF; (c) Capacitor of 10 nF; (d) Capacitor of 100 nF;

FIG. 15 shows a time-coordinated timing diagram during breaking operation for the power consumption control circuit shown in FIG. 1: (a) Time response for the resistance of the energizing contact; (b) Time response for the current of the transient current contact; (c) Time response for a load voltage; (d) Time response for the current of the energizing contact; (e) Time response for the voltage of the energizing contact; (f) Time response for instantaneous power consumption at the energizing contact;

FIG. 16 shows an ideal time-coordinated timing diagram during breaking operation for the power consumption control circuit shown in FIG. 1: (a) Time response for the resistance of the energizing contact; (b) Time response for a load current; (c) Time response for the voltage of the energizing contact; (d) Time response for the load voltage;

FIG. 17 shows a contact voltage during breaking operation for the power consumption control circuit shown in FIG. 1: (a) Source voltage of 42 V, energizing current of 1 A, and no capacitor; (b) Source voltage of 42 V, energizing current of 1 A, and capacitor of 1 nF;

FIG. 18 shows a modified circuit with a resistance and/or a switch in parallel with the capacitor for the power consumption control circuit shown in FIG. 1;

FIG. 19 shows a modified circuit with a rectification circuit for the power consumption control circuit shown in FIG. 1: (a) All wave rectification circuit; (b) Half wave rectification circuit;

FIG. 20 shows a time response of the circuit with an AC power supply for the power consumption control circuit shown in FIG. 1: (a) Time response for the AC power supply; (b) Time response for the energizing contact current; (c) Time response for the energizing contact voltage; (d) Time response for the current of the transient current contact;

FIG. 21 shows a time response of the circuit shown in FIG. 19(*a*): (a) Time response for the AC power supply; (b) Time response for the load voltage; (c) Time response for the voltage of the energizing contact; (d) Time response for the current of the energizing contact; (e) Time response for the current of the transient current contact; (f) Time response for the voltage of the transient current contact;

FIG. 22 shows an example of the circuit shown in FIG. 19(*a*);

FIG. 23 shows a measured time response shown in FIG. 22 for the 100 V AC power supply: (a) Time response for the load voltage; (b) Time response for the voltage of the energizing contact; (c) Time response for the current of the energizing contact;

FIG. 24 shows a measured time response for the current and voltage of the energizing contact shown in FIG. 22 for the 50 V DC power supply;

FIG. 25 shows an experimental 3-phase AC circuit shown in FIG. 19(*a*);

FIG. 26 shows a second embodiment of an electric power consumption control circuit;

FIG. 27 shows an ideal time response during making operation for the power consumption control circuit shown in FIG. 26: (a) Time response for a resistance of a energizing contact; (b) Time response for a load voltage; (c) Time response for a voltage of the energizing contact; (d) Time response for a current of the energizing contact; (e) Time response for the current of a transient current contact; (f) Time response for instantaneous power consumption at the transient current contact;

FIG. 28 shows an ideal time response during making operation for the power consumption control circuit shown in FIG. 26: (a) Time response for the resistance of the energizing contact; (b) Time response for a load current; (c) Time response for the voltage of the energizing contact; (d) Time response for the load voltage;

FIG. 29 shows a modified electric circuit with semiconductor switches for the power consumption control circuit shown in FIG. 1;

FIG. 30 shows a time response for the circuit shown in FIG. 29 during making the switch: (a) Time response for the current and voltage of an energizing switch without a transient current switch; (b) Time response for the current and voltage of the energizing switch with the transient current switch; (c) Time response of instantaneous electric power of the energizing switches in the above-mentioned (a) and (b); In (a) and (b), upper and lower waveforms represent a current waveform and a voltage waveform, respectively;

FIG. 31 shows a time response for the circuit shown in FIG. 29 during breaking the switch: (a) Time response for the current and voltage of the energizing switch without the transient current switch; (b) Time response for the current and voltage of the energizing switch with the transient current switch; (c) Time response of the instantaneous electric power of the energizing switches in the above-mentioned (a) and (b); In (a) and (b), upper and lower waveforms represent the current waveform and the voltage waveform, respectively;

FIG. 32 shows an embodiment for a DC motor based on this invention;

FIG. 33 shows an embodiment for a pantograph based on this invention;

FIG. 34 shows an embodiment for a connector based on this invention: (a) Fundamental arrangement; (b) A socket and a plug making contacts during breaking operation; (c) The socket and the plug breaking operation;

FIG. 35 shows an embodiment for a pulse generation device based on this invention;

FIG. 36 shows an equivalent electric circuit of a conventional switching circuit;

FIG. 37 shows a similarity of AC and DC for this invention: (a) Time response for the voltage of an AC power supply; (b) Time scale expanded response for the current and voltage of an AC circuit during breaking operation; (c) Time response for the current and voltage of a DC circuit during breaking operation;

FIG. 38 shows a time response during breaking operation for the circuit with an ideal switch shown in FIG. 36: (a) Time response of a switching resistance; (b) Time response of a switching current; (c) Time response of a switching voltage; (d) Time response of switching instantaneous power consumption;

FIG. 39 shows a time response during breaking operation for the circuit with the conventional switch shown in FIG. 36: (a) Time response of the switching resistance; (b) Time response of the switching current; (c) Time response of the switching voltage; (d) Time response of the switching instantaneous power consumption;

FIG. 40 shows an explanation of current and voltage transitions of the switch during breaking operation;

FIG. 41 shows a typical response for the current and voltage of a conventional electromagnetic relay during breaking operation;

FIG. 42 shows a frequency distribution of surge noise;

FIG. 43 shows a time response during making operation for the circuit with the ideal switch shown in FIG. 36: (a) Time response of the switching resistance; (b) Time response of the switching current; (c) Time response of the switching voltage; (d) Time response of the switching instantaneous power consumption; and FIG. 44 shows a time response during making operation for the circuit with the conventional switch shown in FIG. 36: (a) Time response of the switching resistance; (b) Time response of the switching current; (c) Time response of the switching voltage; (d) Time response of the switching instantaneous power consumption.

DESCRIPTION OF THE REFERENCE CHARACTERS

10: power consumption control circuit
11: power supply
12: equivalent impedance for power supply or load
13: electric contact switching device
14: energizing contact
15: transient current contact
16: capacitor

BEST MODE FOR CARRYING OUT THE INVENTION

Hereafter, embodiments of the present invention will be described based the drawings. FIGS. 1 through 25 show a power consumption control circuit of a first embodiment of the present invention. As shown in FIG. 1, a power consumption control circuit 10 has a power supply 11, an equivalent impedance 12 for such as the power supply and a load, and an electric contact switching device 13.

The power supply 11 is constituted by a DC or AC power supply, and has an internal resistance. The equivalent impedance 12 for such as the power supply and the load can be expressed by series connection with the power supply 11 from the Thevenin-Ho's theorem. The electric contact switching device 13 is connected in series with the equivalent impedance 12 for such as the power supply and the load, and has an energizing contact 14, a transient current contact 15, breaking/making means (not shown), and a capacitor 16.

The energizing contact 14 and the transient current contact 15 are constituted by a switch, respectively, and are connected electrically in parallel with each other. The energizing contact 14 and the transient current contact 15 can do timely controlled making and breaking operations.

As shown in FIG. 2, the breaking/making means is constituted so as to break/make the transient current contact 15 mechanically or electrically based on a breaking/making signal of the energizing contact 14. The breaking/making means makes (turns on) the transient current contact 15 when breaking (turning off) the energizing contact 14. Especially, as shown in FIG. 3, in order to suppress the voltage applying level to the capacitor 16 below a supply voltage at the time of breaking, the transient current contact 15 is broken immediately after the energizing current falls to substantially zero. It should be noted that the breaking/making means is specifically constituted as follows.

As an arrangement for mechanical synchronization, as shown in FIG. 4, the breaking/making means can be constituted, using the distance difference between the contacts, the elasticity difference of contact springs, the mass difference of the contacts, or the like, so that the transient current contact 15 may be broken and made with the time difference with breaking/making of the energizing contact 14. The breaking/making means for a rotating type sliding contact may be constituted as shown in FIG. 5. With the arrangement shown in FIG. 5, an electrode C rotates in the clockwise direction to contact and energize an energizing electrode A. When it rotates further in the clockwise direction, it contacts a transient current electrode B near a narrow insulation area G while contacting the energizing electrode A. It rotates further, and the energizing electrode A is broken while contacting the transient current electrode B.

Additionally, as shown in FIG. 6, the breaking/making means may be a push button switch constituted by adjusting the contact positions of two mechanical spring contacts. In this case, as shown in FIG. 6(*b*), it can be seen that stable arc discharge is suppressed. It can also be seen that a transient current switch B at the time of breaking is shifted to OFF state before the capacitor 16 is charged completely with the supply voltage.

As an arrangement for electrical synchronization, as shown in FIG. 7, the breaking/making means can be constituted by combining two general-purpose electromagnetic relays, one being used as the energizing contact 14 and the other as the transient current contact 15, using a driving current of the electromagnetic relays. In this case, as shown in FIG. 8, it can be seen that the arc discharge is suppressed completely. As shown in FIG. 9, it can also be seen that the stable arc discharge is suppressed from a trace on the surface of the electric contact after 100 times operations.

As shown in FIG. 1, the capacitor 16 is connected in series with the transient current contact 15. The capacity of the capacitor 16 is set so that, when the energizing contact 14 is broken and at the time the current value which flows through the energizing contact 14 falls below the minimum arc discharge current value of the energizing contact 14, the voltage between the energizing contacts 14 falls below the minimum arc discharge voltage value. In one example, it is set up as follows.

As shown in FIG. 10, the resistance between the energizing contacts 14 at the time of breaking, after exhibiting the transient characteristic which depends on the energizing current value due to a temperature rise by current concentration in the energizing contact 14, results in a fully-broken stable state. As shown in FIG. 11, the resistance between the contacts is measured, and this resistance between the contacts as R(t) which carries out transitional change is incorporated in an equivalent circuit for transient current analysis shown in FIG. 12. It should be noted that the AC supply voltage could be treated similarly to that for DC. As shown in FIG. 13, the difference Δt between the time when the current falls below the minimum arc discharge current during breaking the energizing contact 14 and the time when the voltage rises above the minimum arc discharge voltage is calculated. The minimum arc discharge current value and the minimum arc discharge voltage value which vary depending on the material of the electric contact are calculated from the material constant shown in Table 1. If the values are negative, there is no time domain which both values are satisfied at the same time, and the arc discharge is not generated.

Actually, with the general-purpose electromagnetic relay which uses a silver alloy electrode, using R(t) measured as shown in FIG. 11, Δt is obtained by calculating the current and voltage as shown in FIG. 13 in the circuit of FIG. 12. As shown in FIG. 14, by comparing the current dependence of Δt which is calculated plural times by changing the current value and the value of the capacitor 16 with the current dependence of the arc discharge occurrence probability obtained by an electric discharge generating confirmation experiment which was actually conducted many times by changing the current value and the value of the capacitor 16, their trends have a similarity. Thereby, it is understood that the technique of setting up the capacity of the capacitor 16 is appropriate.

Moreover, the capacity of the capacitor 16 is set so that the voltage between the energizing contacts 14 does not exceed the voltage $V \approx Tm/3200$ or $V \approx Tb/3200$, which corresponds to a melting point temperature Tm or a boiling point temperature Tb between the energizing contacts 14. Thus, the capacity of the capacitor 16 is set to prevent, when breaking the energizing contacts 14, a bridge phenomenon or metal evaporation from being generated in the energizing contact 14.

Next, an operation will be described. It should be noted that an equivalent series resistance or an equivalent inductance of the capacitor 16 and the transient current contact 15 could be disregarded. As shown in FIG. 15, in the power consumption control circuit 10, by making the transient current contact 15 using the breaking/making means when breaking the energizing contact 14, the transient current from the power supply 11 is sent through the capacitor 16, and the voltage drop due to the internal resistance of the power supply 11 or due to the equivalent impedance 12 for such as the power supply or the load is generated, so that the power surge of the energizing contact 14 can be suppressed. At this time, the power surge of the energizing contact 14 is determined by variation with time of the equivalent impedance 12 for such as the power supply and the load, the internal resistance of the power supply 11, the capacity of capacitor 16, and the resistance value of the energizing contact 14. For this reason, the power surge of the energizing contact 14 can be designed to exhibit an arbitrary upward curve by changing the capacity of the capacitor 16.

After breaking the energizing contact 14 completely, by breaking the transient current contact 15 using the breaking/making means, the transient current turns to zero in an instant, and the voltage of the energizing contact 14 rises to reach the supply voltage. Thus, the power consumption control circuit 10 can control the power consumption in the energizing contact 14 at the time of breaking. Additionally, since the capacity of the capacitor 16 is set so that, when breaking the energizing contact 14, either of the current or the voltage between the energizing contacts 14 certainly falls below the minimum arc discharge current value or the minimum arc discharge voltage value, generation of the arc discharge can be prevented reliably.

As shown in FIG. 16. in the power consumption control circuit 10, at the time of breaking the energizing contacts 14, by sending the transient current through the capacitor 16 via the transient current contact 15, it can prevent the current which flows through the equivalent impedance 12 for such as the power supply and the load from falling rapidly, and it can be made a loose change. Where the inductance, such as the equivalent impedance 12 for such as the power supply and the load, is L and the current is I, then the surge voltage V becomes $V \propto L\ (dI/dt)$, and the surge noise can be controlled. As shown in FIG. 17, a calculation result by a circuit simulation shows that, when the capacitor 16 is connected, the surge voltage becomes ⅕ or less as compared with when the capacitor 16 is not connected. Thus, it can be seen that the surge noise is controlled.

As shown in FIG. 15, in the power consumption control circuit 10, since the time to make the transient current contact 15 and apply the supply voltage to the capacitor 16 is set only at the time of breaking the energizing contact 14, the small capacitor 16 with large capacity and low pressure resistance can be used, and reduction in the material cost and miniaturization can be attained. Since the transient current contact 15 is broken except the time of breaking the energizing contact 14, the electricity hardly flows into the transient current contact 15. For this reason, the transient current contact 15 smaller than the electric contact for current interception can be used, so that reduction in the material cost and miniaturization can be attained.

The electric contact switching device 13 can apply its principle to all the switches which intercept the current. For example, it is applicable to such as a vacuum current breaker for large power or a semiconductor switch for an inverter.

As shown in FIG. 18, in the power consumption control circuit 10, an electric resistance 17 or a switch 18 may be connected in parallel with the capacitor 16. In this case, the capacitor 16 can be initialized after breaking the transient current contact 15 with the electric resistance 17 or the switch 18. The transient current is restricted when the resistance is connected in series with the transient current contact 15 and the capacitor 16. Moreover, when the inductance is connected in series with the transient current contact 15 and the capacitor 16, it is assumed that the surge voltage may occur momentarily for the rush current to the capacitor 16 to generate the high voltage for a very short time in the order of picosecond or microsecond. However, since it occurs for a short time and the energy is small, there is little influence on the reliability or the lifetime of the electric contact switching device 13.

Furthermore, as shown in FIG. 19, the power consumption control circuit 10 has a rectification circuit 19 connected in series with the transient current contact 15 and the capacitor 16, and the rectification circuit 19 may rectify the current that flows into the capacitor 16 to save the electric charge in the capacitor 16 when breaking the energizing contact 14. The rectification circuit 19 may be either for a full wave or a half wave. Where there is no rectification circuit 19, as shown in FIG. 20, when the speed of the change in supply voltage is higher than that of breaking/making operations of the energizing contact 14 or the transient current contact 15, the steady current other than the transient current may flow into the transient current contact 15 or the capacitor 16 while the energizing contact 14 is broken as well, and the transient current contact 15 may not be broken at a current zero state.

In contrast, where there is the rectification circuit 19, as shown in FIG. 21, also when the speed of the change in supply voltage is higher than that of breaking/making operations of the energizing contact 14, the electric charge can be saved in the capacitor 16 when the energizing contact 14 is broken, and it can prevent the steady current other than the transient current from flowing into the capacitor 16. For this reason, the transient current contact 15 can be broken at a current zero state. Furthermore, by the rectification circuit 19, since specification of the current direction of the capacitor 16 becomes unnecessary in the case of the DC power supply 11, the capacitor 16 with polarity such as the electrolytic capacitor can be used.

As a result of a measurement in the circuit in FIG. 22, as shown in FIG. 23, it can be seen that the arc discharge is not generated. When the power supply 11 is made to apply DC 50 V in the circuit in FIG. 22, as shown in FIG. 24, it can also be seen that the arc discharge is not generated. As shown in FIG. 25, three circuits in FIG. 19(*a*) can be combined, for example, to be applied to a three-phase AC.

FIGS. 26 through 28 show a power consumption control circuit of a second embodiment of the present invention. As shown in FIG. 26, a power consumption control circuit 20 has a power supply 21, a load 22, and an electric contact switching device 23.

The power supply 21 is constituted by a DC or AC power supply, and has the internal resistance. The load 22 is connected to the power supply 21. The electric contact switching device 23 is connected in series with the load 22, and has an energizing contact 24, a transient current contact 25, and an inductance 26.

The energizing contact 24 and the transient current contact 25 are constituted by a switch, respectively, and are electrically connected electrically in parallel with each other. The energizing contact 24 and the transient current contact 25 can do timely controlled making and breaking operations. The electric contact switching device 23 has a configuration that, after making the transient current contact 25 and the transient current of the power supply 21 which flows through the transient current contact 25 is restored to the regular value, the energizing contact 24 is made. The inductance 26 is connected in series with the transient current contact 25.

Next, an operation will be described. As shown in FIG. 27, in the power consumption control circuit 20, when the transient current contact 25 is turned on just before making the energizing contact 24 to connect the inductance 26 to the energizing contact 24, the transient current value is restored to the regular value, and then the voltage between the energizing contacts 24 turns to substantially zero. The energizing contact 24 is made in the state. At this time, by making the contact resistance lower than the equivalent series resistance of the inductance 26, the current flows through the energizing contact 24. Thereby, the power consumption in the energizing contact 24 at the time of making can be controlled. Meanwhile, the transient current contact 25 can be broken at the time when the current value is substantially zero, which is determined by the ratio of the equivalent series resistance of the inductance 26 to the contact resistance of the energizing contact 24.

As shown in FIG. 28, in the power consumption control circuit 20, at the time of making operation of the energizing contact 24, by sending the transient current through the inductance 26 via the transient current contact 25, it can prevent the current from flowing through the load 22 rapidly, and it can be made a loose change. Where the inductance, such as the load 22, is L and the current is I, then the surge voltage V becomes $V \propto L\ (dI/dt)$, and the surge noise can be controlled.

The electric contact switching device 23 can apply its principle to all the switches which intercept the current. For example, it is applicable to such as the vacuum current breaker for large power or the semiconductor switch for the inverter.

As shown in FIG. 29, in the power consumption control circuits 10 and 20, the energizing contacts 14 and 24 and the transient current contacts 15 and 25 may be constituted by a semiconductor switch, respectively. In this case, it is effective when breaking and making the energizing contacts 14 and 24 and the transient current contact 15 and 25 at high speed. The semiconductor switch is constituted by such as the transistor, the FET, or the diode. When it is especially constituted by the power MOSFET which can deal with the large current, generation of heat at the time of making and breaking the switch can be suppressed. The constitution with the semiconductor switch is considered to provide a new technique for mounting or a circuitry design, as well as for an element design. As a result of a measurement in the circuit shown in FIG. 29, in both cases at the time of making the energizing switch shown in FIG. 30 and at the time of breaking the energizing switch shown in FIG. 31, it can be seen that the power consumption is reduced and the surge noise is controlled.

FIG. 32 shows a DC motor of an embodiment of the invention. As shown in FIG. 32, a DC motor 30 has a pair of brushes 31, an armature 32, and a pair of commutators 33. The brush 31 is made from carbon and is connected to the power supply. The armature 32 is constituted by the coil and is placed in the magnetic field.

The respective commutators 33 are disposed on both ends of the armature 32. The respective commutators 33 are constituted so that they contact respective brushes 31 by the turning of the armature 32, send the DC through the armature 32, and rotate the armature 32 by the electromagnetic force. Each commutator 33 has two contacts 34, 35 and a capacitor 36. The respective contacts 34, 35 are aligned in the direction of rotation so that they may be connected electrically in parallel with each other when contacted by the brush 31. The capacitor 36 is connected in series with the contact 35 at the back side of the direction of rotation.

Next, an operation will be described. The DC motor 30 applies the power consumption control circuit 10 shown in FIG. 1, forms the energizing contact 14 with the contact 34 at the front side of the direction of rotation and the respective brushes 31, and forms the transient current contact 15 with the contact 35 at the back side and the respective brushes 31. As shown in FIG. 32, since the DC motor 30 contacts the contact 35 at the back side when the brush 31 which contacts the contact 34 at the front side of the direction of rotation separates from the contact 34 by rotation of the commutator 33, it can send the transient current from the power supply through the capacitor 36. Thereby, the voltage drop by such as the internal resistance of the power supply is generated and the power surge between the brush 31 and the contact 34 at the front side is suppressed, so that generation of the arc discharge therein can be prevented and the power consumption can be controlled.

FIG. 33 shows a pantograph device of an embodiment of the invention. As shown in FIG. 33, a pantograph device 40 has a pair of pantographs 41, 42 and a capacitor 43. The respective pantographs 41, 42 are arranged to be connected electrically in parallel with each other when contacted to an overhead wiring 44. The capacitor 43 is connected in series with one pantograph 42.

Next, an operation will be described. The pantograph device 40 applies the power consumption control circuit 10 shown in FIG. 1, forms the energizing contact 14 with the overhead wiring 44 and the other pantograph 41, and forms the transient current contact 15 with the overhead wiring 44 and one pantograph 42. As shown in FIG. 33, in the pantograph 40, as long as the other pantograph 42 contacts the overhead wiring 44 while the other pantograph 41 is separated from the overhead wiring 44 by such as vibration depending on its elasticity or structure, it can send the transient current from the overhead wiring 44 through the capacitor 43. Thereby, the voltage drop by such as the internal resistance of the overhead wiring 44 is generated and the power surge between the overhead wiring 44 and the other pantograph 41 is suppressed, so that generation of the arc discharge therein can be prevented and the power consumption can be controlled.

FIG. 34 shows a connector of an embodiment of the present invention. As shown in FIG. 34, a connector 50 has a socket 51, a plug 52, a socket side branch line 53, a plug side branch line (not shown), a capacitor 54, and an electric resistance 55. A socket side energizing line 56 is connected to the socket 51. The socket side energizing line 56 has a socket side energizing contact 57 at the tip. The plug 52 can be inserted in the socket 51 for connection, and a plug side energizing line 58 is connected thereto. The plug side energizing line 58 has a plug side energizing contact 59 at the tip. When the plug 52 is connected to the socket 51, the plug side energizing line 58 can be conducted to the socket side energizing line 56.

The socket side branch line 53 branches from the socket side energizing line 56 before the socket side energizing contact 57, and has a socket side transient current contact 60 at the tip. The plug side branch line branches from the plug side energizing line 58 before the plug side energizing contact 59, and has a plug side transient current contact 61 at the tip. The capacitor 54 is disposed on the socket side branch line 53. The electric resistance 55 is disposed in parallel with the capacitor 54.

Next, an operation will be described. The connector 50 applies the power consumption control circuit 10 shown in FIG. 1, forms the energizing contact 14 with the socket side energizing contact 57 and the plug side energizing contact 59, and forms the transient current contact 15 with the socket side transient current contact 60 and the plug side transient current contact 61.

As shown in FIG. 34, in the connector 50, when the plug 52 is inserted in the socket 51 for connection, the socket side energizing contact 57 and the plug side energizing contact 59 are made. Thereby, the socket side energizing line 56 and the plug side energizing line 58 are conducted. When the plug 52 is removed from the socket 51, the plug 52 is rotated with regard to the socket 51 to make the socket side transient current contact 60 and the plug side transient current contact 61, and then break the socket side energizing contact 57 and the plug side energizing contact 59 while maintaining the making state. At this time, the transient current from the power supply can be sent through the capacitor 54. Thereby, the voltage drop by such as the internal resistance of the power supply is generated and the power surge between the socket side energizing contact 57 and the plug side energizing contact 59 is suppressed, so that generation of the arc discharge therein can be prevented and the power consumption can be controlled. In this state, the plug 52 is drawn out from the socket 51.

FIG. 35 shows a pulse generation device 70 of an embodiment of the present invention.

As shown in FIG. 35, a pulse generation device 70 has a rotor 71, a plurality of rotating electrodes 72, a contact electrode 73, a connection electrode 74, a capacitor 75, and an electric resistance 76. In this case, the pulse generation device 70 applies the constitution shown in FIG. 5.

The rotor 71 is constituted by a disk and has an insulator on the surface.

The respective rotating electrodes 72 are separated by the insulator from each other and disposed on the surface of the rotor 71 symmetrically for a rotating axis of the rotor 71. Each rotating electrode 72 is constituted by a front side electrode A placed at the front side of the direction of rotation of the rotor 71 and a back side electrode B placed at the back side of the direction of rotation. The respective rotating electrodes 72 are disposed so that a spacing 72*a* with the adjacent rotating electrode 72 is wider than a spacing 72*b* between the front side electrode A and the back side electrode B. The front side electrode A extends further toward the periphery of the rotor 71 than the back side electrode B. The front side electrodes A of the respective rotating electrodes 72 are connected electrically in parallel with each other. The back side electrodes B of the respective rotating electrodes 72 are connected electrically in parallel with each other. The front side electrode A and the back side electrode B are connected electrically in parallel with each other to the power supply 77.

The contact electrode 73 is connected to one terminal of the power supply 77, and is disposed so as to contact the respective rotating electrodes 72 sequentially and intermittently during rotation of the rotor 71. The contact electrode 73 is formed so that width 73*a* which contacts the respective rotating electrodes 72 is narrower than the spacing 72*a* between the respective rotating electrodes 72 and wider than the spacing 72*b* between the front side electrode A and the back side electrode B. The contact electrode 73 is disposed to contact the front side electrode A and the back side electrode B of the respective rotating electrodes 72 in the order corresponding to the front side electrode A, the front and back side electrodes A and B, and the back side electrode B.

The contact electrode 74 is connected to the other terminal of the power supply 77, and is disposed near the periphery of the rotor 71 so as to contact the front side electrode A of the respective rotating electrodes 72 sequentially and not to contact the back side electrode B during rotation of the rotor 71. The contact electrode 74 is formed so that width 74*a* which contacts the front side electrode A of the respective rotating electrodes 72 is wider than a spacing 72*c* between the front side electrodes A of the respective rotating electrodes 72. The contact electrode 74 always contacts any of the front side electrodes A of the respective rotating electrodes 72.

The capacitor 75 is connected in series with the back side electrode B of the respective rotating electrodes 72.

The electric resistance 76 is disposed in parallel with the capacitor 75.

Next, an operation will be described.

The pulse generation device 70 applies the power consumption control circuit 10 shown in FIG. 1, forms the energizing contact with the front side electrode A and the contact electrode 73, and forms the transient current contact with the back side electrode B and the contact electrode 73.

The pulse generation device 70 can generate the current pulse train or the voltage pulse train, and can be used for such the inverter device. Since the contact electrode 73 is provided so as to contact the front and back side electrodes A and B of the respective rotating electrodes 72, in the order corresponding to the front side electrode A, the front and back side electrodes A and B, and the back side electrode B, when the contact electrode 73 separates from the front side electrode A, the transient current from the power supply 77 can be sent though the capacitor 75. Thereby, the voltage drop by such as the internal resistance of the power supply 77 is generated and power surge between the contact electrode 73 and the front side electrode A is suppressed, so that generation of the arc discharge therein can be prevented and the power consumption can be controlled.

The invention claimed is:

1. An electric contact switching device comprising:

an energizing contact;

a transient current contact; and a capacitor, wherein the energizing contact and the transient current contact are connected electrically in parallel with each other, and the energizing contact and the transient current contact can do timely controlled making and breaking operations, wherein said capacitor is connected in series with said transient current contact, and wherein the capacity of the capacitor is calculated by transient current analysis using an equivalent circuit with a measured contact resistance between the energizing contacts during its breaking operation, and wherein calculated decreasing time of a contact current to the minimum arc discharge current is shorter than calculated increasing time of a contact voltage to the minimum arc discharge voltage during the breaking operation of the energizing contact.

2. The device according to claim 1, wherein the transient current contact is in making state during the breaking operation of the energizing contact.

3. The device according to claim 1, wherein an electric resistance or a switch is connected in parallel with the capacitor.

4. The device according to claim 1, wherein the capacitor is characterized so that a voltage V of the energizing contact is set to the capacity that doesn't exceed the voltage $V \approx Tm/3200$ (Tm: melting point temperature of the energizing contact) or $V \approx Tb/3200$ (Tb: boiling point temperature of the energizing contact)

5. The device according to claim 1, further comprising mechanical or electrical making and breaking means for the transient current contact, based on a making and breaking signal of the energizing contact.

6. The device according to claim 1, comprising a rectification circuit and rectifying the current that flows into the capacitor to save electric charge in the capacitor during the breaking operation of the energizing contact.

7. The device according to claim 6, comprising the transient current contact connected in series with the rectification circuit.

8. The device according to claim 1, wherein the energizing contact and the transient current contact consist of semiconductor switches.

9. A power consumption control circuit comprising:

a power supply;

a load; and the switching device according to claim 1, wherein the load and the power supply are connected, and wherein the switching device is connected in series with the load, wherein when the transient current contact is in making state and a transient current from the power supply flows into the capacitor during a breaking operation of an energizing contact, and wherein a transient current path through the load and an internal resistance of the power supply suppress the voltage rise at the energizing contact.

10. A DC motor which a pair of brushes connected to the power supply are made to contact with a pair of commutators provided on both ends of an armature by turning of the armature, to send the direct current through the armature placed in a magnetic field, and to rotate the armature in response to an electromagnetic force, wherein, for the commutators to be electrically connected electrically in parallel with each other when contacted to the brushes, each commutator has two contacts aligned in the direction of rotation and a capacitor connected in series with the contact at the back side of the direction of rotation, and wherein the capacity of the capacitor is calculated by transient current analysis using an equivalent circuit, in which a contact between the brush and the commutator is replaced with a measured transient contact resistance, and wherein calculated decreasing time of a contact current to the minimum arc discharge current is shorter than calculated increasing time of a contact voltage to the minimum are discharge voltage during a breaking operation of the brush and the commutator.

11. A pantograph device with a movable energizing contact to an overhead wiring comprising:

a pair of pantographs; and a capacitor, wherein each pantograph is arranged to be connected electrically in parallel with the overhead wiring;

wherein the capacitor is connected in series with one of the pantographs; and wherein the capacity of the capacitor is calculated by transient current analysis using an equivalent circuit with a measured contact resistance of the energizing contact during its breaking operation, and wherein calculated decreasing time of a contact current to the minimum arc discharge current is shorter than calculated increasing time of a contact voltage to the minimum arc discharge voltage during the breaking operation of the energizing contact.

12. A connector to conduct a socket side energizing line connected to a socket and a plug side energizing line connected to a plug by connecting the socket and the plug, comprising:

a socket side branch line;

a plug side branch line; and a capacitor, wherein the socket side energizing line has a socket side energizing contact, wherein the socket side branch line is branched from the socket side energizing line and has a socket side transient current contact, wherein the plug side energizing line has a plug side energizing contact, wherein the plug side branch line is branched from the plug side energizing line and has a plug side transient current contact, wherein the capacitor is disposed either on the socket side branch line or the plug side branch line, wherein the capacity of the capacitor is calculated by transient current analysis using an equivalent circuit with a measured contact resistance between the energizing contacts of the socket and the plug during its breaking operation, and wherein calculated decreasing time of a contact current to the minimum arc discharge current is shorter than calculated increasing time of a contact voltage to the minimum arc discharge voltage during the breaking operation of the energizing contacts. of the socket and the plug, and comprising a mechanical making and breaking operation of the socket and the plug, and wherein the socket side energizing contact and the plug side energizing contact are made when the socket is connected to the plug, and the socket side transient current contact and the plug side transient current contact are made when the socket is connected to or removed from the plug, and wherein, while maintaining the making state, the socket side energizing contact and the plug side energizing contact are broken to remove the socket from the plug.

13. A pulse generation device comprising a rotor with rotating electrodes, contact electrodes, and capacitors, wherein the rotating electrodes are electrically separated from each other with an isolator, symmetrically arranged for a rotating axis of the rotor, wherein the rotating electrodes comprise front side electrodes and back side electrodes connected electrically in parallel with each other to a power supply, and the contact electrodes make and break contact with the rotating electrodes during rotation of the rotor and contact the front side electrodes and the back side electrodes step by step, wherein the capacitors are connected in series with the back side electrodes, and wherein the capacity of the capacitor is calculated by transient current analysis using an equivalent circuit with a measured contact resistance between the rotating electrodes and the contact electrodes during its breaking operation, and wherein calculated decreasing time of a contact current to the minimum arc discharge current is shorter than calculated increasing time of a contact voltage to the minimum arc discharge voltage during the breaking operation of the contact electrodes.

* * * * *